US008371366B2

(12) United States Patent
Higashiyama et al.

(10) Patent No.: US 8,371,366 B2
(45) Date of Patent: Feb. 12, 2013

(54) HEAT EXCHANGER

(75) Inventors: Naohisa Higashiyama, Oyama (JP); Yukihiro Tsurumi, Oyama (JP)

(73) Assignee: Showa Denko K.K., Tokyo (JP)

( * ) Notice: Subject to any disclaimer, the term of this patent is extended or adjusted under 35 U.S.C. 154(b) by 763 days.

(21) Appl. No.: 12/310,119

(22) PCT Filed: Feb. 10, 2007

(86) PCT No.: PCT/JP2007/069276

§ 371 (c)(1),
(2), (4) Date: Feb. 11, 2009

(87) PCT Pub. No.: WO2008/041698

PCT Pub. Date: Apr. 10, 2008

(65) Prior Publication Data

US 2009/0236086 A1 Sep. 24, 2009

(30) Foreign Application Priority Data

Oct. 3, 2006 (JP) ..... 2006-271606

(51) Int. Cl.
*F28D 7/06* (2006.01)
*F28F 9/02* (2006.01)
*F28D 1/02* (2006.01)

(52) U.S. Cl. ..... 165/176; 165/174; 165/153

(58) Field of Classification Search ..... 165/174, 165/176, 151, 152, 153, 173
See application file for complete search history.

(56) References Cited

U.S. PATENT DOCUMENTS 6,199,401 B1 * 3/2001 Haussmann ..... 165/174
7,055,585 B2 * 6/2006 Higashiyama ..... 165/153

(Continued)

FOREIGN PATENT DOCUMENTS

JP 2001-050684 2/2001
JP 2001-255039 9/2001

(Continued)

OTHER PUBLICATIONS

International Search Report mailed Nov. 13, 2007, issued on PCT/JP2007/069276.

(Continued)

*Primary Examiner* — Ljiljana Ciric
*Assistant Examiner* — Jason Thompson
(74) *Attorney, Agent, or Firm* — Edwards Wildman Palmer LLP

(57) ABSTRACT

An evaporator 1 is configured such that two heat exchange tube groups 16, each composed of a plurality of heat exchange tubes 15, are provided between a pair of header tanks 2, 3, while being separated from each other in a front-rear direction. Each of the header tanks 2, 3 includes two header sections 5, 6, 11, 12. Each header tank 2, 3 includes a first member 21, 93 to which the heat exchange tubes 15 are connected, and a second member 22, 94 which is joined to the first member 21, 93 and covers the side of the first member 21, 93 opposite the heat exchange tubes 15. Partition portions 41, 42 for dividing the interiors of the header section 5, 6, 11, 12 into upper and lower spaces 5*a*, 5*b*, 6*a*, 6*b* are provided on the second member 22, 94 of the header tank 2, 3. Through holes 47, 51A, 101, 102 for establishing communication between the upper and lower spaces 5*a*, 5*b*, 6*a*, 6*b* of the header section 5, 6, 11, 12 are formed in the partition portions 41, 42. The second member 22, 94 is formed by bending a metal plate. This evaporator 1 requires a reduced number of components and facilitates production work.

24 Claims, 25 Drawing Sheets

U.S. PATENT DOCUMENTS

| | | | | |
|---|---|---|---|---|
| 2005/0126770 | A1 * | 6/2005 | Higashiyama | 165/174 |
| 2008/0223566 | A1 * | 9/2008 | Higashiyama et al. | 165/176 |

FOREIGN PATENT DOCUMENTS

| | | | |
|---|---|---|---|
| JP | 2002-357395 | | 12/2002 |
| JP | 2006-170598 | | 6/2006 |
| JP | 2006-183994 | | 7/2006 |
| WO | WO 2005/085739 | * | 9/2005 |
| WO | WO 2005/108899 | * | 11/2005 |
| WO | WO 2006/064823 | * | 6/2006 |

OTHER PUBLICATIONS

Office Action mailed Apr. 10, 2012, issued for the Japanese Patent Application No. 2008-537532 and partial English translation thereof.

* cited by examiner

HEAT EXCHANGER

TECHNICAL FIELD

The present invention relates to a heat exchanger preferably used as an evaporator of a car air conditioner, which is a refrigeration cycle to be mounted on, for example, an automobile.

Herein and in the appended claims, the upper, lower, left-hand, and right-hand sides of FIG. 2 will be referred to as "upper," "lower," "left," and "right," respectively. Also, herein and in the appended claims, the downstream side (a direction represented by arrow X in FIGS. 1 and 3) of an air flow through air-passing clearances between adjacent heat exchange tubes will be referred to as the "front," and the opposite side as the "rear."

BACKGROUND ART

The applicant of the present application has proposed an improved heat exchanger as an evaporator for a car air conditioner which satisfies the needs of reducing size and weight and enhancing performance (see Patent Document 1). In the improved heat exchanger, a plurality of heat exchange tube groups are arranged in a front-rear direction between upper and lower header tanks separated from each other in a vertical direction. Each heat exchange tube group consists of a plurality of heat exchange tubes which are arranged at predetermined intervals along the longitudinal direction of the header tanks and whose opposite end portions are connected to the corresponding header tanks. Each of the header tanks includes two header sections arranged in the front-rear direction and integrated together. Each of header tanks is composed of a first member which is formed of an aluminum brazing sheet and to which all the heat exchange tubes are connected; and a second member which is formed of an aluminum extrudate and which is joined to the first member so as to cover the side of the first member opposite the heat exchange tubes. A single heat exchange tube group is provided between each header section of the upper header tank and the corresponding header section of the lower header tank. The front header section of the upper header tank serves as a refrigerant inlet header section; the rear header section of the upper header tank serves as a refrigerant outlet header section; the front header section of the lower header tank serves as a first intermediate header section; and the rear header section of the lower header tank serves as a second intermediate header section. A refrigerant inlet is formed in one end portion of the refrigerant inlet header section, and a refrigerant outlet is formed in an end portion of the refrigerant outlet header section located on the same side as the end portion of the refrigerant inlet header section. The interiors of the refrigerant inlet header section, the refrigerant outlet header section, and the second intermediate header section are each divided into upper and lower spaces by means of a partition portion formed integrally with the corresponding second member. The upper and lower spaces within the refrigerant inlet header section communicate with each other via a communication hole formed in the partition portion at an end portion opposite the refrigerant inlet and the refrigerant outlet, as well as via a plurality of refrigerant-passage through holes formed in the partition portion at intervals in the longitudinal direction. The upper and lower spaces of the refrigerant outlet header section communicate with each other via refrigerant-passage through holes formed in the corresponding partition portion. Similarly, the upper and lower spaces of the second intermediate header section communicate with each other via refrigerant-passage through holes formed in the corresponding partition portion. Further, the space within the first intermediate header section and the lower space within the second intermediate header section communicate with each other via a communication portion provided in one end portion of the lower header tank with respect to the longitudinal direction thereof. In the heat exchanger, the second member is formed of an aluminum extrudate.

Incidentally, in order to improve the heat exchange performance of the heat exchanger described in Patent Document 1, the divided flow of refrigerant to all the heat exchange tubes must be controlled such that discharged-air temperature, or the temperature of air having passed through the heat exchanger, becomes uniform among different portions of the heat exchanger. In order to control the divided flow of refrigerant to all the heat exchange tubes, it is necessary to properly control the flow of refrigerant from the upper space to the lower space within the refrigerant inlet header section, the flow of refrigerant from the lower space within the refrigerant inlet header section to all the heat exchange tubes of the front heat exchange tube group, and the flow of refrigerant from the upper space within the second intermediate header section to all the heat exchange tubes of the rear heat exchange tube group. Such flow control can be effectively performed by means of forming the partition portions of the refrigerant inlet header section and the second intermediate header section to have a complicated shape, or forming flanges around the through holes of the partition portions of the refrigerant inlet header section and the second intermediate header section such that the flanges project toward the heat exchange tubes.

However, in the case of the heat exchanger described in Patent Document 1, since each second member having an integrally formed partition portion is formed of an aluminum extrudate, the partition portion can be formed only into the shape of a flat plate. In addition, since the through holes are formed by performing press working on the partition portion, it is impossible to form flanges around the through holes such that the flanges project toward the heat exchange tubes. Accordingly, in the case of the heat exchanger described in Patent Document 1, separate components must be provided in order to control the divided flow of refrigerant to all the heat exchange tubes such that discharged-air temperature, or the temperature of air having passed through the heat exchanger, becomes uniform among different portions of the heat exchanger. In this case, there arise problems that the number of components increases, and production work becomes troublesome.

Patent Document 1: Japanese Patent Application Laid-Open (kokai) No. 2006-183994

DISCLOSURE OF THE INVENTION

Problem to be Solved by the Invention

An object of the present invention is to solve the above problem and to provide a heat exchanger which is composed of a reduced number of components and whose production work is easy.

Means for Solving the Problem

To achieve the above object, the present invention comprises the following modes.

1) A heat exchanger comprising a pair of header tanks disposed such that they are separated from each other; and a plurality of heat exchange tube groups arranged in a front-rear direction between the header tanks, each heat exchange tube group consisting of a plurality of heat exchange tubes which are arranged at predetermined intervals along a longitudinal direction of the header tanks and whose opposite end portions are connected to the corresponding header tanks, and each of the header tanks including two header sections arranged in the front-rear direction and integrated together, wherein each of header tanks is composed of a first member to which the heat exchange tubes are connected and a second member which is joined to the first member and covers a side of the first member opposite the heat exchange tubes, and at least one heat exchange tube group is provided between each header section of one header tank and the corresponding header section of the other header tank, wherein the second member of at least one head tank is formed by bending a metal plate; two partition portions which divide the two header sections into respective upper and lower spaces, respectively, are provided on the second member formed by bending the metal plate; and through holes for establishing communication between the upper and lower spaces of each header section are formed in each of the partition portions.

2) A heat exchanger according to par. 1), wherein the second members of the two header tanks are each formed by bending a metal plate.

3) A heat exchanger according to par. 1), wherein a plurality of through holes are formed in the partition portion of the second member provided within a header section in which refrigerant flows into the heat exchange tubes.

4) A heat exchanger according to par. 3), wherein flanges are integrally formed on a surface of the partition portion having the plurality of through holes, the surface facing the heat exchange tubes, such that the flanges project toward the heat exchange tubes from circumferential edges of the corresponding through holes.

5) A heat exchanger according to par. 3), wherein guide portions for guiding refrigerant toward the heat exchange tubes from the space opposite the heat exchange tubes are integrally formed on one surface of the partition portion having the plurality of through holes such that the guide portions project from circumferential edges of the corresponding through holes.

6) A heat exchanger according to par. 5), wherein the guide portions are integrally formed on a surface of the partition portion having the plurality of through holes, the surface facing the heat exchange tubes, such that the guide portions project from portions of circumferential edges of the corresponding through holes, the portions being located on the upstream sides of the through holes with respect to a flow direction of refrigerant within a space, opposite the heat exchange tubes, of the header section in which refrigerant flows into the heat exchange tubes.

7) A heat exchanger according to par. 5), wherein the guide portions are integrally formed on a surface of the partition portion having the plurality of through holes, the surface facing opposite the heat exchange tubes, such that the guide portions project from portions of circumferential edges of the corresponding through holes, the portions being located on the downstream sides of the through holes with respect to a flow direction of refrigerant within a space, opposite the heat exchange tubes, of the header section in which refrigerant flows into the heat exchange tubes.

8) A heat exchanger according to par. 3), wherein each of the through holes is formed between adjacent heat exchange tubes.

9) A heat exchanger according to par. 1), wherein a plurality of bulging portions are formed on the partition portion of the second member provided within a header section in which refrigerant flows into the heat exchange tubes such that the bulging portions project toward the heat exchange tubes and each have a flat projecting end wall; and at least one bulging portion includes a through hole formed in the projecting end wall.

10) A heat exchanger according to par. 9), wherein each of the bulging portions is formed between adjacent heat exchange tubes.

11) A heat exchanger according to par. 1), wherein hemispherical bulging portions are formed on the partition portion of the second member provided within a header section in which refrigerant flows into the heat exchange tubes such that the bulging portions project toward the heat exchange tubes; and at least one bulging portion includes a plurality of through holes formed therein.

12) A heat exchanger according to par. 1), wherein a plurality of projecting portions each having a V-shaped transverse cross section are formed on the partition portion of the second member provided within a header section in which refrigerant flows into the heat exchange tubes such that the projecting portions project toward the heat exchange tubes and extend in a width direction of the header tank; and a through hole is formed in a projecting portion such that the through hole extends over opposite wall portions of the projecting portion, which wall portions form the V shape.

13) A heat exchanger according to par. 1), wherein a plurality of projecting portions each having a V-shaped transverse cross section are formed on the partition portion of the second member provided within a header section in which refrigerant flows into the heat exchange tubes such that the projecting portions project toward the heat exchange tubes and extend in a width direction of the header tank; and a through hole is formed in each of opposite wall portions of a projecting portion, which wall portions form the V shape.

14) A heat exchanger according to par. 1), wherein the second member includes front and rear horizontal plate-shaped partition portions connected together via a connection portion, and front and rear header forming portions which are provided on vertically outer sides of the partition portions and form vertically outer portions of the header sections; each header forming portion has a generally U-shaped transverse cross section such that the header forming portion opens vertically inward and its central portion with respective to the front-rear direction projects vertically outward; an outer edge portion of each header forming portion with respective to the front-rear direction is integrally connected to an outer edge portion of the corresponding partition portion with respective to the front-rear direction; and an inner edge portion of each header forming portion with respective to the front-rear direction is engaged with the connection portion between the front and rear partition portions.

15) A heat exchanger according to par. 14), wherein the connection portion between the front and rear partition portions of the second member assumes the form of a horizontal plate; a plurality of through holes are formed in the connection portion such that the through holes are separated from one another in a longitudinal direction of the connection portion; a surface contact portion assuming the form of a horizontal plate is integrally formed at an inner edge portion of each header forming portion with respective to the front-rear direction, the surface contact portion projecting inward with respective to the front-rear direction and being in surface contact with a vertically outer surface of the connection portion; a plurality of projections which project vertically inward and are inserted into some of the through holes of the connection portion are integrally formed at an inner edge portion of the surface contract portion with respective to the front-rear direction such that the projections are separated from one another in the longitudinal direction; all the through holes of the connection portion are divided into a group of through holes into which the projections of the front header forming portion are inserted, a group of through holes into which the projections of the rear header forming portion are inserted, and a group of through holes into which the projections of the two header forming portions are not inserted and which serve as drain through holes.

16) A heat exchanger according to par. 15), wherein abutment pieces are integrally formed on a distal end surface of the surface contract portion of each header forming portion of the second member, the abutment pieces projecting toward the surface contract portion of the other header forming portion and abutting against the surface contract portion, wherein the abutment pieces are formed such that they do not interfere with the projections of the two header forming portions and the drain through holes of the connection portion.

17) A heat exchanger according to par. 1), wherein the second member includes front and rear header forming portions which are connected together via a connection portion and form vertically outer portions of the header sections, and front and rear horizontal plate-shaped partition portions which are provided on vertically inner sides of the header forming portions; each header forming portion has a generally U-shaped transverse cross section such that the header forming portion opens vertically inward and its central portion with respective to the front-rear direction projects vertically outward; an outer edge portion of each partition portion with respective to the front-rear direction is integrally connected to an outer edge portion of the corresponding header forming portion with respective to the front-rear direction; and an inner edge portion of each partition portion with respective to the front-rear direction is engaged with the connection portion between the front and rear header forming portions.

18) A heat exchanger according to par. 17), wherein the connection portion between the front and rear header forming portions of the second member assumes the form of a horizontal plate; a plurality of through holes are formed in the connection portion such that the through holes are separated from one another in a longitudinal direction of the connection portion; a surface contact portion assuming the form of a horizontal plate is integrally formed at an inner edge portion of each partition portion with respective to the front-rear direction, the surface contact portion projecting inward with respective to the front-rear direction and being in surface contact with a vertically inner surface of the connection portion; a plurality of projections which project vertically outward and are inserted into some of the through holes of the connection portion are integrally formed at an inner edge portion of the surface contract portion with respective to the front-rear direction such that the projections are separated from one another in the longitudinal direction; all the through holes of the connection portion are divided into a group of through holes into which the projections of the front partition portion are inserted, a group of through holes into which the projections of the rear partition portion are inserted, and a group of through holes into which the projections of the two partition portions are not inserted and which serve as drain through holes.

19) A heat exchanger according to par. 18), wherein abutment pieces are integrally formed on a distal end surface of the surface contract portion of each partition portion of the second member, the abutment pieces projecting toward the surface contract portion of the other partition portion and abutting against the surface contract portion, wherein the abutment pieces are formed such that they do not interfere with the projections of the two partition portions and the drain through holes of the connection portion.

20) A heat exchanger according to par. 1), wherein engagement portions with which front and rear edge portions of the first member are engaged are formed at front and rear edge portions of the second member engage.

21) A heat exchanger according to par. 1), wherein the second member includes front and rear header forming portions which are connected together via a connection portion and form vertically outer portions of the header sections, and front and rear horizontal plate-shaped partition portions which are provided on vertically inner sides of the header forming portions and which are connected together via a connection portion; each header forming portion has a generally U-shaped transverse cross section such that the header forming portion opens vertically inward and its central portion with respective to the front-rear direction projects vertically outward; an outer edge portion, with respective to the front-rear direction, of one of the front and rear partition portions is integrally connected to an outer edge portion, with respective to the front-rear direction, of the corresponding header forming portion which forms a head section whose interior is divided into upper and lower spaces by the one partition portion; and an outer edge portion of the other partition portion with respective to the front-rear direction is engaged with an outer edge portion, with respective to the front-rear direction, of the corresponding header forming portion which forms a head section whose interior is divided into upper and lower spaces by the other partition portion.

22) A heat exchanger according to par. 1), wherein the front header section of one header tank serves as a refrigerant inlet header section, the rear header section of the one header tank serves as a refrigerant outlet header section, the front header section of the other header tank serves as a first intermediate header section, and the rear header section of the other header tank serves as a second intermediate header section; a refrigerant inlet is formed in one end portion of the refrigerant inlet header section, and a refrigerant outlet is formed in one end portion of the refrigerant outlet header section located on the same side as the end portion of the refrigerant inlet header section; and each of the refrigerant inlet header section and the second intermediate header section serves as a header section in which refrigerant flows into the heat exchange tubes.

23) A heat exchanger according to par. 22), wherein a communication hole is formed in an end portion of the partition portion opposite the refrigerant inlet and the refrigerant outlet so as to establish communication between the two spaces of the refrigerant inlet header section; and a communication portion is provided at one longitudinal end of the header tank so as to establish communication between an outer space of the first intermediate header section with respect to the vertical direction and an outer space of the second intermediate header section with respect to the vertical direction.

Effects of the Invention

According to the heat exchanger of par. 1), the second member of at least one head tank is formed by bending a metal plate; two partition portions which divide the two header sections into respective upper and lower spaces, respectively, are provided on the second member formed by bending the metal plate; and through holes for establishing communication between the upper and lower spaces of each header section are formed in each of the partition portions. Therefore, the partition portion can be formed into a complicated shape relatively simply through working performed on a metal plate serving as a raw material. Accordingly, the partition portion can be formed into a shape suitable for controlling the divided flow of refrigerant to all the heat exchange tubes such that discharged-air temperature, or the temperature of air having passed through the heat exchanger, becomes uniform among different portions of the heat exchanger. As a result, provision of separate components becomes unnecessary, the number of components decreases, and production work becomes easier.

According to the heat exchanger of par. 2), the above-described effect of the heat exchanger of par. 1) is further enhanced.

According to the heat exchanger of par. 3), a plurality of through holes are formed in the partition portion of the second member provided within a header section in which refrigerant flows into the heat exchange tubes. Therefore, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of par. 4), flanges are integrally formed on a surface of the partition portion facing the heat exchange tubes such that the flanges project toward the heat exchange tubes from circumferential edges of the corresponding through holes. By virtue of the action of the flanges, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchangers of pars. 5) and 7), the above-described effect of the heat exchanger of par. 3) is further enhanced by the action of the guide portions.

According to the heat exchanger of par. 6), the guide portions can generate a flow of refrigerant in a direction opposite the flow direction of refrigerant in the heat-exchange-tube-side space of the header section in which refrigerant flows into the heat exchange tubes. Therefore, the divided flow can be made uniform through mixing of refrigerant within the heat-exchange-tube-side space of the header section.

According to the heat exchanger of par. 8), the above-described effect of the heat exchanger of any of pars. 3) to 7) is further enhanced.

According to the heat exchanger of par. 9), a plurality of bulging portions are formed on a portion of the partition portion present within a header section in which refrigerant flows into the heat exchange tubes such that the bulging portions project toward the heat exchange tubes and each have a flat projecting end wall; and at least one bulging portion includes a through hole formed in the projecting end wall. Therefore, by the action of the bulging portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of par. 10), the above-described effect of the heat exchanger of par. 9) is further enhanced.

According to the heat exchanger of par. 11), a plurality of hemispherical bulging portions are formed on a portion of the partition portion present within a header section in which refrigerant flows into the heat exchange tubes such that the bulging portions project toward the heat exchange tubes; and at least one bulging portion includes a plurality of through holes formed therein. Therefore, by the action of the bulging portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchangers of pars. 12) and 13), a plurality of projecting portions each having a V-shaped transverse cross section are formed on a portion of the partition portion present within a header section in which refrigerant flows into the heat exchange tubes such that the projecting portions project toward the heat exchange tubes and extend in a width direction of the header tank; and a through hole is formed in a projecting portion such that it extends over opposite wall portions of the projecting portion, which wall portions form the V shape. Therefore, by the action of the projecting portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of pars. 15), when the heat exchanger is used as an evaporator, condensed water accumulated between the two header sections of each header tank can be drained in an improved manner.

According to the heat exchanger of pars. 16), when the second member is formed by bending a metal plate, a space can be secured between the two header sections, and accuracy in terms of the shapes of the two header sections can be improved.

According to the heat exchanger of pars. 18), when the heat exchanger is used as an evaporator, condensed water accumulated between the two header sections of each header tank can be drained in an improved manner.

According to the heat exchanger of pars. 19), when the second member is formed by bending a metal plate, accuracy in terms of the shape of the second member can be improved.

According to the heat exchanger of pars. 20), at the time of manufacture, positioning of the first member and the second member can be performed simply.

BEST MODE FOR CARRYING OUT THE INVENTION

An embodiment of the present invention will next be described in detail with reference to the drawings. The embodiment is of a heat exchanger according to the present invention that is applied to an evaporator of a car air conditioner using a chlorofluorocarbon-based refrigerant.

In the following description, the term "aluminum" includes aluminum alloys in addition to pure aluminum.

Further, the same reference numerals are used throughout the drawings to refer to similar parts or elements, and their repeated descriptions are omitted.

FIGS. 1 and 2 show the overall configuration of an evaporator, and FIGS. 3 to 16 show the configuration of a main portion of the evaporator.

As shown in FIGS. 1 to 3, the evaporator (1) is configured such that a heat exchange core section (4) is provided between a refrigerant inlet/outlet header tank (2) made of aluminum and a refrigerant turn header tank (3) made of aluminum, which are separated from each other in the vertical direction.

The refrigerant inlet/outlet header tank (2) includes a refrigerant inlet header section (5) located on the front side (downstream side with respect to the air flow direction); a refrigerant outlet header section (6) located on the rear side (upstream side with respect to the air flow direction); and a connection portion (7) for mutually connecting the header sections (5) and (6) for integration. A refrigerant inlet pipe (8) made of aluminum is connected to the refrigerant inlet header section (5) of the refrigerant inlet/outlet header tank (2). A refrigerant outlet pipe (9) made of aluminum is connected to the refrigerant outlet header section (6) of the refrigerant inlet/outlet header tank (2).

The refrigerant turn header tank (3) includes a first intermediate header section (11) located on the front side; a second intermediate header section (12) located on the rear side; and a connection portion (13) for mutually connecting the header sections (11) and (12) for integration. The header sections (11) and (12) and the connection portion (13) form a drain trough (14). The circumferential walls of the refrigerant inlet/outlet header tank (2) and the refrigerant turn header tank (3) have transverse cross sectional shapes which are identical with each other but are mirror images with respect to the vertical direction.

The heat exchange core section (4) is configured such that heat exchange tube groups (16) are arranged in a plurality of; herein, two, rows in the front-rear direction, each heat exchange tube group (16) consisting of a plurality of heat exchange tubes (15) arranged in parallel at predetermined intervals in the left-right direction. Corrugate fins (17) are disposed within air-passing clearances between the adjacent heat exchange tubes (15) of the heat exchange tube groups (16) and on the outer sides of the leftmost and rightmost heat exchange tubes (15) of the heat exchange tube groups (16), and are brazed to the corresponding heat exchange tubes (15). Side plates (18) made of aluminum are disposed on the outer sides of the leftmost and rightmost corrugate fins (17), and are brazed to the corresponding corrugate fins (17). The upper and lower ends of the heat exchange tubes (15) of the front heat exchange tube group (16) are connected to the refrigerant inlet header section (5) and the first intermediate header section (11), respectively. The upper and lower ends of the heat exchange tubes (15) of the rear heat exchange tube group (16) are connected to the refrigerant outlet header section (6) and the second intermediate header section (12), respectively. The refrigerant inlet header section (5) and the second intermediate header section (12) are header sections in which refrigerant flows into the heat exchange tubes (15).

Each of the heat exchange tubes (15) is formed from a bare aluminum extrudate, and assumes a flat form such that its width direction coincides with the front-rear direction. The heat exchange tube (15) has a plurality of refrigerant channels arranged in parallel in the width direction. Each of the corrugated fins (17) is made in a wavy form from an aluminum brazing sheet having a brazing material layer over opposite surfaces thereof. Each of the corrugate fins (17) includes wave crest portions, wave trough portions, and horizontal flat connection portions connecting the wave crest portions and the wave trough portions. A plurality of louvers are formed at the connection portions in such a manner as to be juxtaposed in the front-rear direction. The front and rear heat exchange tubes (15) that constitute the front and rear heat exchange tube groups (16) share the corrugate fins (17). The width of each corrugate fin (17) as measured in the front-rear direction is generally equal to the distance between the front edges of the front heat exchange tubes (15) and the rear edges of the rear heat exchange tubes (15). The wave crest portions and the wave trough portions of the corrugate fins (17) are brazed to the front and rear heat exchange tubes (15). The front edges of the corrugate fins (17) slightly project frontward from the front edges of the front heat exchange tubes (15). Notably, instead of a single corrugate fin being shared between the front and rear heat exchange tube groups (16), a corrugate fin may be disposed between the adjacent heat exchange tubes (15) of each of the front and rear heat exchange tube groups (16).

As shown in FIGS. 3 to 9, the refrigerant inlet/outlet header tank (2) is composed of a plate-shaped first member (21), a second member (22), and aluminum end members (23) and (24). The first member (21) is formed from an aluminum brazing sheet having a brazing material layer over opposite surfaces thereof. All the heat exchange tubes (15) are connected to the first member (21). The second member (22) is formed from an aluminum brazing sheet having a brazing material layer over opposite surfaces thereof, and covers the upper side (the side opposite the heat exchange tubes (15)) of the first member (21). The aluminum end members (23) and (24) are formed from an aluminum brazing sheet having a brazing material layer over opposite surfaces thereof, and are brazed to the left and right ends of the first member (21) and the second member (22). A joint plate (25) made of aluminum and elongated in the front-rear direction is brazed to the outer surface of the right end member (24) while extending over the refrigerant inlet header section (5) and the refrigerant outlet header section (6). The refrigerant inlet pipe (8) and the refrigerant outlet pipe (9) are joined to the joint plate (25).

The first member (21) includes a first header forming portion (26) which bulges downward and forms a lower portion of the refrigerant inlet header section (5); a second header forming portion (27) which bulges downward and forms a lower portion of the refrigerant outlet header section (6); and a connection wall (28) which connects a rear edge portion of the first header forming portion (26) and a front edge portion of the second header forming portion (27) and forms a lower portion of the connection portion (7). The first header forming portion (26) includes a horizontal flat bottom wall (29), and front and rear walls (31) and (32) integrally formed at the front and rear edge portions of the bottom wall (29). The front wall (31) includes a slant portion (31*a*) obliquely extending upward from the front edge of the bottom wall (29) toward the front side, and a vertical portion (31*b*) extending upward from the upper edge of the slant portion (31*a*). The rear wall (32) obliquely extends upward toward the rear side, and its upper end portion extends vertically. The upper end of the front wall (31) is located above that of the rear wall (32). The second header forming portion (27), which is a mirror image of the first header forming portion (26) with respect to the left-right direction, includes a horizontal flat bottom wall (33), and rear and front walls (34) and (35) integrally formed at the rear and front edge portions of the bottom wall (33). The rear wall (34) includes a slant portion (34*a*) obliquely extending upward from the rear edge of the bottom wall (33) toward the rear side, and a vertical portion (34*b*) extending upward from the upper edge of the slant portion (34*a*). The front wall (35) obliquely extends upward toward the front side, and its upper end portion extends vertically. The upper end of the rear wall (34) is located above that of the front wall (35). The upper edge of the rear wall (32) of the first header forming portion (26) and the upper edge of the front wall (35) of the second header forming portion (27) are integrally connected by the connection wall (28).

A plurality of tube insertion holes (36), which are elongated in the front-rear direction, are formed in the two header forming sections (26) and (27) of the first member (21) at predetermined intervals in the left-right direction. The tube insertion holes (36) of the first header forming section (26) and those of the second header forming section (27) are identical in position in the left-right direction. The tube insertion holes (36) of the first header forming section (26) are formed to extend from the slant portion (31*a*) of the front wall (31) to the rear wall (32); and the tube insertion holes (36) of the second header forming section (27) are formed to extend from the slant portion (34*a*) of the rear wall (34) to the front wall (35). Upper end portions of the heat exchange tubes (15) of the front and rear heat exchange tube groups (16) of the heat exchange core section (4) are inserted into the tube insertion holes (36) of the header forming sections (26) and (27), and are brazed to the first member (21) by making use of the brazing material layer of the first member (21). Thus, the upper end portions of the heat exchange tubes (15) of the front heat exchange tube group (16) are connected to the refrigerant inlet header section (5) such that fluid communication is established therebetween; and the upper end portions of the heat exchange tubes (15) of the rear heat exchange tube group (16) are connected to the refrigerant outlet header section (6) such that fluid communication is established therebetween. A plurality of drain through holes (37), which are elongated in the left-right direction, are formed in the connection wall (28) of the first member (21) at predetermined intervals in the left-right direction. Further, a plurality of fixation through holes (38) are formed in the connection wall (28) of the first member (21) at predetermined intervals in the left-right direction such that the fixation through holes (38) are located at positions shifted from the positions of the drain through holes (37). In the present embodiment, the drain through holes (37) and the fixation through holes (38) are formed alternately.

The second member (22) includes front and rear horizontal plate-shaped partition portions (41) and (42) which partition the interiors of the refrigerant inlet header section (5) and the refrigerant outlet header section (6) into upper and lower spaces (5*a*) and (5*b*) and upper and lower spaces (6*a*) and (6*b*), respectively; a connection wall (43) (connection portion) which connects the front and rear partition portions (41) and (42) together and is brazed to the connection wall (28) of the first member (21) to thereby form an intermediate portion of the connection portion (7); a first header forming portion (44) which is provided above the front partition portion (41), bulges upward, and forms an upper portion of the refrigerant inlet header section (5); and a second header forming portion (45) which is provided above the rear partition portion (42), bulges upward, and forms an upper portion of the refrigerant outlet header section (6).

The front partition portion (41) of the second member (22) has a cutout (46) extending from the left end thereof. Further, in a central portion of the partition portion (41) with respect to the front-rear direction, a plurality of refrigerant-passage circular through holes (47) are formed at predetermined intervals in the left-right direction so as to establish communication between the upper and lower spaces (5*a*) and (5*b*) of the refrigerant inlet header section (5). Flanges (48) in the form of a short circular tube are integrally formed on the lower surface (the surface facing the heat exchange tubes (15)) of the partition portion (41) such that the flanges (48) project downward (toward the heat exchange tubes (15)) from the circumferential edges of the corresponding through holes (47) and surround the corresponding through holes (47). Each through hole (47) and the corresponding flange (48) are formed between two adjacent heat exchange tubes (15). Further, in a rear portion of the rear partition portion (42) of the second member (22), excluding left and right end portions thereof, a plurality of refrigerant-passage elliptical through holes (51A) and (51B) are formed at predetermined intervals in the left-right direction such that the through holes (51A) and (51B) elongate in the left-right direction and establish communication between the upper and lower spaces (6*a*) and (6*b*) of the refrigerant outlet header section (6). Flanges (52A) and (52B) in the form of a short tube are integrally formed on the upper surface of the partition portion (42) such that the flanges (52A) and (52B) project upward from the circumferential edges of the corresponding through holes (51A) and (51B) and surround the corresponding through holes (51A) and (51B). The central elliptical through hole (51A) is shorter than the remaining elliptical through holes (51B), and is located between adjacent heat exchange tubes (15).

A plurality of drain through holes (53) and a plurality of fixation through holes (54) are formed in the connection wall (43) of the second member (22) such that they coincide with the drain through holes (37) and the fixation through holes (38) of the connection wall (28) of the first member (21).

The first header forming portion (44) of the second member (22) has a generally U-shaped transverse cross section such that the first header forming portion (44) opens downward (vertically inward), and its central portion with respective to the front-rear direction projects upward (vertically outward). A front edge portion (an edge portion located on the outer side with respective to the front-rear direction) of the first header forming portion (44) is continuous with (integrally connected to) a front edge portion (an edge portion located on the outer side with respective to the front-rear direction) of the front partition portion (41). A rear edge portion (an edge portion located on the inner side with respective to the front-rear direction) of the first header forming portion (44) is bent rearward to thereby form a horizontal surface contact portion (55), which is brazed, in a surface contact state, to a front half of the upper surface of the connection wall (43). The rear edge of the surface contact portion (55) is located at a position where it does not close the drain through holes (53) and the fixation through holes (54) of the connection wall (43). A plurality of projections (56) are formed at the rear edge of the surface contact portion (55) to be separated from one another in the left-right direction (see FIG. 13). The projections (56), which extend downward, are inserted into the fixation through holes (54) and (38) of the connection wall (43) of the second member (22) and the connection wall (28) of the first member (21), and are brazed to the connection walls (43) and (28). Further, a plurality of abutment pieces (57) are integrally formed at the rear edge of the surface contact portion (55) such that the abutment pieces (57) project rearward, abut against a front edge of a surface contract portion (61) of a second header forming portion (45) to be described later, and is brazed to the surface contract portion (61). The abutment pieces (57) are formed at locations shifted from the drain through holes (37) and (53) and the fixation through holes (38) and (54) of the first and second members (21) and (22) such that they do not interfere with these through holes (37), (53), (38), and (54). A lower end portion of a front wall portion of the first header forming portion (44) is deformed rearward over its entire length, whereby an engagement portion (58) is formed at the front edge of the first header forming portion (44) over the entire length thereof. The upper end of the vertical portion (31*b*) of the front wall (31) of the first header forming portion (26) of the first member (21) abuts against the engagement portion (58).

The second header forming portion (45) of the second member (22) is a mirror image of the first header forming portion (44) with respect to the left-right direction. That is, the second header forming portion (45) has a generally U-shaped transverse cross section such that the second header forming portion (45) opens downward (vertically inward), and its central portion with respective to the front-rear direction projects upward (vertically outward). A rear edge portion (an edge portion located on the outer side with respective to the front-rear direction) of the second header forming portion (45) is continuous with (integrally connected to) a rear edge portion (an edge portion located on the outer side with respective to the front-rear direction) of the rear partition portion (42). A front edge portion (an edge portion located on the inner side with respective to the front-rear direction) of the second header forming portion (45) is bent frontward to thereby form a horizontal surface contact portion (61), which is brazed, in a surface contact state, to a rear half of the upper surface of the connection wall (43). The front edge of the surface contact portion (61) is located at a position where it does not close the drain through holes (53) and the fixation through holes (54) of the connection wall (43). A plurality of projections (62) are formed at the front edge of the surface contact portion (61) to be separated from one another in the left-right direction. The projections (61), which extend downward, are inserted into the fixation through holes (54) and (38) of the connection wall (43) of the second member (22) and the connection wall (28) of the first member (21), and are brazed to the connection walls (43) and (28). The projections (56) and (62) of the two header forming portions (44) and (45) are inserted into the fixation through holes (54) and (38) alternately in the left-right direction. Further, a plurality of abutment pieces (63) are integrally formed at the front edge of the surface contact portion (61) such that the abutment pieces (63) project frontward, abut against the front edge of the surface contract portion (55) of the first header forming portion (44), and is brazed to the surface contract portion (55). The abutment pieces (63) are formed at locations shifted from the drain through holes (37) and (53) and the fixation through holes (38) and (54) of the first and second members (21) and (22) such that they do not interfere with these through holes (37), (53), (38), and (54). A lower end portion of a rear wall portion of the second header forming portion (45) is deformed frontward over its entire length, whereby an engagement portion (64) is formed at the rear edge of the second header forming portion (45) over the entire length thereof. The upper end of the vertical portion (34*b*) of the rear wall (34) of the second header forming portion (27) of the first member (21) abuts against the engagement portion (64).

The second member (22) is formed from a blank aluminum brazing sheet having a brazing material layer over opposite surfaces thereof as follows. The connection wall (43), the cutout (46), the circular through holes (47), the flanges (48), the elliptical through holes (51A) and (51B), the flanges (52A) and (52B), the drain through holes (53), the fixation through holes (54), the surface contact portions (55) and (61), the projections (56) and (62), the abutment pieces (57) and (63), and the engagement portions (58) and (64) are formed on the blank sheet. Subsequently, the blank sheet is bent by a suitable method so as to form the two partition portions (41) and (42) and the first and second header forming portions (44) and (45) (see FIG. 10), and the projections (56) and (62) are inserted into the fixation through holes (54) (see FIG. 11). Predetermined portions of this semi-finished product are brazed, whereby the second member (22) is completed. Notably, brazing of the predetermined portions of this semi-finished product is performed simultaneously with brazing of other components at the time of manufacture of the evaporator (1).

The first header forming portion (26) of the first member (21) and the first header forming portion (44) of the second member (22) form a hollow inlet-header-section main body (65) whose opposite ends are opened. The second header forming portion (27) of the first member (21) and the second header forming portion (45) of the second member (22) form a hollow outlet-header-section main body (66) whose opposite ends are opened.

The left end member (23) includes a front cap (23*a*) for closing the left end opening of the inlet-header-section main body (65), and a rear cap (23*b*) for closing the left end opening of the outlet-header-section main body (66). The front cap (23*a*) and the rear cap (23*b*) are integrated together via a connection portion (23*c*). The front cap (23*a*) of the left end member (23) includes upper and lower rightward projecting portions (67) integrally formed such that they are separated from each other in the vertical direction. The upper and lower rightward projecting portion (67) are fitted into the interior of the inlet-header-section main body (65). The rear cap (23*b*) includes an upper rightward projecting portion (68) and a lower rightward projecting portion (69) integrally formed such that they are separated from each other in the vertical direction. The upper rightward projecting portion (68) is fitted into the space (6*a*) of the outlet-header-section main body (66) located above the partition portion (42). The lower rightward projecting portion (69) is fitted into the space (6*b*) of the outlet-header-section main body (66) located below the flow control wall (42). Engagement fingers (71) projecting rightward for engagement with the first and second members (21) and (22) are formed integrally with the left end member (23) at connection portions between the front and rear side edges and the upper and lower edges. The left end member (23) is brazed to the two members (21) and (22) by making use of the brazing material layer of itself. The left end opening of the cutout (46) of the front partition portion (41) is closed by the front cap (23*a*) of the left end member (23) so as to form a communication hole (72) which establishes mutual communication between the upper and lower spaces (5*a*) and (5*b*) of the refrigerant inlet header section (5) at the left end thereof. Notably, in the present embodiment, the communication hole (72) is formed by means of closing the left end opening of the cutout (46) by the front cap (23*a*). Alternatively, instead of forming the cutout, a through hole may be formed in a left end portion of the front partition portion as the communication hole.

The right end member (24) includes a front cap (24*a*) for closing the right end opening of the inlet-header-section main body (65), and a rear cap (24*b*) for closing the right end opening of the outlet-header-section main body (66). The front cap (24*a*) and the rear cap (24*b*) are integrated together via a connection portion (24*c*). The front cap (24*a*) of the right end member (24) includes an upper leftward projecting portion (73) and a lower leftward projecting portion (74) integrally formed such that they are separated from each other in the vertical direction. The upper leftward projecting portion (73) is fitted into the space (5*a*) of the inlet-header-section main body (65) located above the front partition portion (41). The lower leftward projecting portion (74) is fitted into the space (5*b*) of the inlet-header-section main body (65) located below the front partition portion (41). Similarly, the rear cap (24*b*) includes an upper leftward projecting portion (75) and a lower rightward projecting portion (76) integrally formed such that they are separated from each other in the vertical direction. The upper leftward projecting portion (75) is fitted into the space (6*a*) of the outlet-header-section main body (66) located above the rear partition portion (42). The lower leftward projecting portion (76) is fitted into the space (6*b*) of the outlet-header-section main body (66) located below the rear partition portion (42). A refrigerant inlet (77) is formed in a projecting end wall of the upper leftward projecting portion (73) of the front cap (24*a*) of the right end member (24). Similarly, a refrigerant outlet (78) is formed in a projecting end wall of the upper leftward projecting portion (75) of the rear cap (24*b*) of the right end member (24). Engagement fingers (79) projecting leftward for engagement with the first and second members (21) and (22) are formed integrally with the right end member (24) at connection portions between the front and rear side edges and the upper edge, and at front and rear portions of the lower edge.

As shown in FIGS. 12 and 14, a first engagement male portion (81) is formed integrally with the connection portion (24*c*) of the right end member (24) such that the first engagement male portion (81) projects upward from a central portion of the upper end of the connection portion (24*c*) with respect to the front-rear direction. Similarly, a second engagement male portion (82) is formed integrally with the connection portion (24*c*) of the right end member (24) such that the second engagement male portion (82) projects downward from a central portion of the lower end of the connection portion (24*c*) with respect to the front-rear direction. In a state before the right end member (24) is assembled to the joint plate (25) during the manufacture of the evaporator (1), the second engagement male portion (82) projects rightward. The second engagement male portion projecting rightward is denoted by (82A) (see a chain line in FIG. 14). Further, cutouts (92) are formed in front and rear end potions of a lower edge portion of the right end member (24). The right end member (24) is brazed to the members (21) and (22) by making use of the brazing material layer of itself.

The joint plate (25) includes a short, cylindrical refrigerant inflow port (83) communicating with the refrigerant inlet (77) of the right end member (24), and a short, cylindrical refrigerant outflow port (84) communicating with the refrigerant outlet (78) of the right end member (24). The refrigerant inflow port (83) and the refrigerant outflow port (84) are each composed of a circular through hole and a short cylindrical tubular portion formed integrally with the joint plate (25) such that the short cylindrical tubular portion surrounds the through hole and projects rightward.

The joint plate (25) has a vertically extending slit for short prevention (85) formed between the refrigerant inflow port (83) and the refrigerant outflow port (84), and generally trapezoidal through holes (86) and (87) communicating with the upper and lower ends of the slit (85), respectively. Portions of the joint plate (25) located above the upper through hole (86) and below the lower through hole (87) are bent in a U-like shape so as to project leftward (toward the right end member (24)) to thereby form first and second engagement female portions (88) and (89). The first engagement male portion (81) of the right end member (24) is inserted into the first engagement female portion (88) from the lower side thereof for engagement with the first engagement female portion (88). The second engagement male portion (82) of the right end member (24) is inserted into the second engagement female portion (89) from the upper side thereof for engagement with the second engagement female portion (89). Thus, movement of the joint plate (25) in the left-right direction is prevented. The second engagement male portion (82) of the right end member (24) in a state in which it projects rightward as indicated by a chain line in FIG. 14 is passed through the lower through hole (87), and then bent downward, whereby the second engagement male portion (82) is inserted into the second engagement female portion (89) from the upper side thereof. The first engagement female portion (88) is in engagement with front and rear side portions of the first engagement male portion (81) of the connection portion (24*c*) of the right end member (24), whereby downward movement of the joint plate (25) is prevented. Moreover, engagement fingers (91) projecting leftward are formed integrally with the joint plate (25) at front and rear end portions of the lower edge thereof. The joint plate (25) is engaged with the right end member (24) with the engagement fingers (91) fitted into the cutouts (92) formed along the lower edge of the right end member (24). Thus, upward, frontward, and rearward movements of the joint plate (25) are prevented. The joint plate (25) is brazed to the right end member (24) by making use of the brazing material layer of the right end member (24) in a state in which the joint plate (25) is engaged with the right end member (24) such that leftward and rightward movements, upward and downward movements, and frontward and rearward movements of the joint plate (25) are prevented as described above.

A diameter-reduced portion of the refrigerant inlet pipe (8) formed at one end thereof is inserted into and brazed to the refrigerant inflow port (83) of the joint plate (25). Similarly, a diameter-reduced portion of the refrigerant outlet pipe (9) formed at one end thereof is inserted into and brazed to the refrigerant inflow port (84) of the joint plate (25). Although not illustrated in the drawings, an expansion valve attachment member is joined to the opposite end portions of the refrigerant inlet pipe (8) and the refrigerant outlet pipe (9) such that the expansion valve attachment member extends over the two pipes (8) and (9).

As shown in FIGS. 3, 15, and 16, the refrigerant turn header tank (3) is composed of a plate-shaped first member (93), a second member (94), aluminum end members (95) and (96), and a communication member (97). The first member (93) is formed from an aluminum brazing sheet having a brazing material layer over opposite surfaces thereof. All the heat exchange tubes (15) are connected to the first member (93). The second member (94) is formed from an aluminum brazing sheet having a brazing material layer over opposite surfaces thereof, and covers the lower side of the first member (93). The aluminum end members (95) and (96) are formed from an aluminum brazing sheet having a brazing material layer over opposite surfaces thereof, and are brazed to the left and right ends of the first member (93) and the second member (94). The communication member (97), which is made of an aluminum bare material and extends in the front-rear direction, is brazed to an outer surface of the right end member (96) such that the communication member (97) extends over the first intermediate header section (11) and the second intermediate header section (12). The first intermediate header section (11) and the second intermediate header section (12) communicate with each other at their right ends via the communication member (97).

The first member (93) has the same structure as the first member (21) of the refrigerant inlet/outlet header tank (2), and is a mirror image of the first member (21) with respect to the vertical direction. Like portions are denoted by like reference numerals. The first header forming portion (26) forms an upper portion (a vertically inner portion) of the first intermediate header section (11); and the second header forming portion (27) forms an upper portion (a vertically inner portion) of the second intermediate header section (12). Lower end portions of the heat exchange tubes (15) of the front and rear heat exchange tube groups (16) of the heat exchange core section (4) are inserted into tube insertion holes (36), and are brazed to the first member (21) by making use of the brazing material layer of the first member (21). Thus, the lower end portions of the heat exchange tubes (15) of the front heat exchange tube group (16) are connected to the first intermediate header section (11) such that fluid communication is established therebetween; and the lower end portions of the heat exchange tubes (15) of the rear heat exchange tube group (16) are connected to the second intermediate header section (12) such that fluid communication is established therebetween.

The second member (94) has the same structure as the second member (22) of the refrigerant inlet/outlet header tank (2), except for the structure of the front and rear partition portions (41) and (42), and is a mirror image of the second member (22) with respect to the vertical direction. Like portions are denoted by like reference numerals. The first header forming portion (44) forms a lower portion of the first intermediate header section (11); and the second header forming portion (45) forms a lower portion of the second intermediate header section (12). The front partition portion (41) of the second member (94) of the refrigerant turn header tank (3) has a plurality of relatively large rectangular through holes (101) formed at predetermined intervals in the left-right direction such that they extend in the left-right direction. Further, the rear partition portion (42) has a plurality of circular refrigerant-passage through holes (102) formed in a rear portion thereof at predetermined intervals in the left-right direction. The distance between adjacent circular refrigerant-passage through holes (102) gradually increases with the distance from the right end. Flanges (103) in the form of a short circular tube are integrally formed on the upper surface (the surface facing the heat exchange tubes (15)) of the partition portion (42) such that the flanges (103) project upward (toward the heat exchange tubes (15)) from the corresponding through holes (102) and surround the corresponding through holes (102). Each through hole (102) and the corresponding flange (103) are formed between two adjacent heat exchange tubes (15). Notably, the distance between adjacent circular refrigerant-passage through holes (102) may be constant among all the circular refrigerant-passage through holes (102). The front partition portion (41) divides the interior of the first intermediate header section (11) into upper and lower spaces (11*a*) and (11*b*), and the rear partition portion (42) divides the interior of the second intermediate header section (12) into upper and lower spaces (12*a*) and (12*b*).

The first header forming portion (26) of the first member (93) and the first header forming portion (44) of the second member (94) form a hollow first intermediate-header-section main body (104) whose opposite ends are opened. The second header forming portion (27) of the first member (93) and the second header forming portion (45) of the second member (94) form a hollow second intermediate-header-section main body (105) whose opposite ends are opened.

The left end member (95) is a mirror image of the left end member (23) of the refrigerant inlet/outlet header tank (2) with respect to the vertical direction. The left end member (95) includes a front cap (95*a*) for closing the left end opening of the first-intermediate-header-section main body (104), and a rear cap (95*b*) for closing the left end opening of the second-intermediate-header-section main body (105). The front cap (95*a*) and the rear cap (95*b*) are integrated together via a connection portion (95*c*). The front cap (95*a*) includes an upper rightward projecting portion (106) and a lower rightward projecting portion (107) integrally formed such that they are separated from each other in the vertical direction. The upper rightward projecting portion (106) is fitted into the space (11*a*) of the first-intermediate-header-section main body (104) located above the partition portion (41). The lower rightward projecting portion (107) is fitted into the space (11*b*) of the first-intermediate-header-section main body (104) located below the partition portion (41). Similarly, the rear cap (95*b*) includes an upper rightward projecting portion (108) and a lower rightward projecting portion (109) integrally formed such that they are separated from each other in the vertical direction. The upper rightward projecting portion (108) is fitted into the space (12*a*) of the second-intermediate-header-section main body (105) located above the partition portion (42). The lower rightward projecting portion (109) is fitted into the space (12*b*) of the second-intermediate-header-section main body (105) located below the partition portion (42). Engagement fingers (111) projecting rightward for engagement with the first and second members (93) and (94) are formed integrally with the left end member (95) at arcuate portions between the front and rear side edges and the upper and lower edges. The left end member (95) is brazed to the two members (93) and (94) by making use of the brazing material layer of itself.

The right end member (96) includes a front cap (96*a*) for closing the right end opening of the first-intermediate-header-section main body (104), and a rear cap (96*b*) for closing the right end opening of the second-intermediate-header-section main body (105). The front cap (96*a*) and the rear cap (96*b*) are integrated together via a connection portion (96*c*). The front cap (96*a*) includes an upper leftward projecting portion (112) and a lower leftward projecting portion (113) integrally formed such that they are separated from each other in the vertical direction. The upper leftward projecting portion (112) is fitted into the space (11*a*) of the first-intermediate-header-section main body (104) located above the partition portion (41). The lower leftward projecting portion (113) is fitted into the space (11*b*) of the first-intermediate-header-section main body (104) located below the partition portion (41). Similarly, the rear cap (96*b*) includes an upper leftward projecting portion (114) and a lower rightward projecting portion (115) integrally formed such that they are separated from each other in the vertical direction. The upper leftward projecting portion (114) is fitted into the space (12*a*) of the second-intermediate-header-section main body (105) located above the partition portion (42). The lower leftward projecting portion (115) is fitted into the space (12*b*) of the second-intermediate-header-section main body (105) located below the partition portion (42). Engagement fingers (116) projecting leftward for engagement with the first and second members (93) and (94) are formed integrally with the right end member (96) at arcuate portions between the front and rear side edges and the upper and lower edges. The right end member (96) has integrally formed engagement fingers (117) which project rightward from front and rear end portions of the upper edge of the right end member (96). The engagement fingers (117) are bent downward for engagement with an upper edge portion of the communication member (97). The right end member (96) also has an integrally formed engagement finger (117) which projects rightward from a central portion of the lower edge of the right end member (96) with respect to the front-rear direction. The engagement finger (117) is bent upward for engagement with a lower edge portion of the communication member (97). A refrigerant outflow opening (118) is formed in a projecting end wall of the lower leftward projecting portion (113) of the front cap (96*a*) of the right end member (96) so as to allow refrigerant to flow out of the space (11*b*) of the first intermediate header section (11) located below the partition portion (41). Similarly, a refrigerant inflow opening (119) is formed in a projecting end wall of the lower leftward projecting portion (115) of the rear cap (96*b*) of the right end member (96) so as to allow refrigerant to flow into the space (12*b*) of the second intermediate header section (12) located below the partition portion (42).

Further, a guide portion (121), which is upwardly inclined or curbed (in the present embodiment, curved) toward the interior of the second intermediate header section (12), is integrally formed at a lower portion of the circumferential edge of the refrigerant inflow opening (119) of the lower leftward projecting portion (115) of the rear cap (96*b*). The guide portion (121) guides upward the refrigerant flowing into the space (12*b*) of the second intermediate header section (12) located below the partition portion (42). The right end member (96) is brazed to the first and second members (93) and (94) by making use of the brazing material layer of itself.

The communication member (97) is formed from an aluminum bare material through press working, and assumes the form of a plate whose outer shape is identical in shape and size with the right end member (96) as viewed from the right. A circumferential edge portion of the communication member (97) is brazed to the outer surface of the right end member (96) by making use of the brazing material layer of the right end member (96). The communication member (97) has an outward bulging portion (122) for establishing communication between the refrigerant outflow opening (118) and the refrigerant inflow opening (119) of the right end member (96). The interior of the outward bulging portion (122) serves as a communication passage for establishing communication between the refrigerant outflow opening (118) and the refrigerant inflow opening (119) of the right end member (96). Cutouts (123) for receiving the engagement fingers (117) of the right end member (96) are formed at front and rear end portions of the upper edge of the communication member (97), as well as at a central portion of the lower edge of the communication member (97) with respect to the front-rear direction.

In manufacture of the above-described evaporator (1), all the components thereof, excluding the inlet pipe (8) and the outlet pipe (9), are assembled together, and the resultant assembly is subjected to batch brazing.

The evaporator (1), together with a compressor and a condenser (serving as a refrigerant cooler), constitutes a refrigeration cycle, which uses a chlorofluorocarbon-based refrigerant and is installed in a vehicle, for example, an automobile, as a car air conditioner.

In the evaporator (1) described above, when the compressor is on, two-phase refrigerant of vapor-liquid phase having passed through the compressor, the condenser and an expansion valve enters the upper space (5*a*) of the refrigerant inlet header section (5) of the refrigerant inlet/outlet header tank (2) from the refrigerant inlet pipe (8) through the refrigerant inflow port (83) of the joint plate (25) and the refrigerant inlet (77) of the front cap (24*a*) of the right end member (24). Then, the refrigerant having entered the upper space (5*a*) of the refrigerant inlet header section (5) flows leftward and subsequently flows into the lower space (5*b*) via the through holes (72), as well as the through holes (47) of the partition portion (41).

The refrigerant having entered the lower space (5*b*) dividedly flows into the refrigerant channels of the heat exchange tubes (15) of the front heat exchange tube group (16). The refrigerant having entered the refrigerant channels of the heat exchange tubes (15) flows downward through the refrigerant channels and enters the upper space (11*a*) of the first intermediate header section (11) of the refrigerant turn header tank (3). The refrigerant having entered the upper space (11*a*) of the first intermediate header section (11) enters the lower space (11*b*) via the through holes (101) of the partition portion (41), and then flows rightward in the lower space (11*b*). The refrigerant then flows through the refrigerant outflow opening (118) of the front cap (96*a*) of the right end member (96), the communication passage within the outward bulging portion (122) of the communication member (97), and the refrigerant inflow opening (119) of the rear cap (96*b*), thereby turning its flow direction and entering the lower space (12*b*) of the second intermediate header section (12).

The refrigerant having entered the lower space (12*b*) of the second intermediate header section (12) flows leftward; enters the upper space (12*a*) via the through holes (102) of the partition portion (42); and dividedly flows into the refrigerant channels of the heat exchange tubes (15) of the rear heat exchange tube group (16). At that time, the guide portion (121) guides the refrigerant to flow in an upwardly inclined leftward direction; i.e., flow into the lower space (12*b*) toward the partition portion (42). As a result, in cooperation with the through holes (102) formed in the partition portion (42) such the distance between adjacent through holes (102) gradually increases toward the left end, the distribution (in the left-right direction) of the refrigerant flowing into the upper space (12*a*) via the through holes (102) is made uniform as compared with the case where the guide portion (121) is not provided. Therefore, the refrigerant becomes more likely to uniformly flow into the heat exchange tubes (15) connected to the second intermediate header section (12). Accordingly, the distribution of the refrigerant in the heat exchange core section (4) hardly becomes non-uniform, whereby the temperature of air having passed through the heat exchange core section (4) becomes uniform, and the heat exchange performance is improved.

The refrigerant having flown into the refrigerant channels of the heat exchange tubes (15) flows upward within the refrigerant channels, while changing its flow direction; enters the lower space (6*b*) of the refrigerant outlet header section (6); and enters the upper space (6*a*) through the through holes (51A) and (51B) of the partition portion (42).

Next, the refrigerant having entered the upper space (6*a*) of the refrigerant outlet header section (6) flows rightward, and flows out to the refrigerant outlet pipe (9) through the refrigerant outlet (78) of the rear cap (24*b*) of the right end member (24) and the refrigerant outflow port (84) of the joint plate (25).

While flowing through the refrigerant channels of the heat exchange tubes (15) of the front and rear heat exchange tube groups (16), the refrigerant is subjected to heat exchange with the air flowing through the air-passing clearances of the heat exchange core section (4), and flows out from the evaporator (1) in a vapor phase.

FIGS. 17 to 36 show modifications of the second member used in the refrigerant inlet/outlet header tank (2) and the refrigerant turn header tank (3).

In the case of a second member (125) shown in FIGS. 17 and 18, each of the first header forming portion (44) and the second header forming portion (45) has a plurality of strip-shaped outward bulging portions (126) formed such that they extend from an outside portion to an inside portion of the corresponding header forming portion with respect to the front-rear direction and are separated from one another with respect to the longitudinal direction of the corresponding header forming portion. Outer end portions of the outward bulging portions (126) with respect to the front-rear direction serve as engagement portions (127), against which the distal end of the vertical portion (31*b*) of the front wall (31) of the first header forming portion (26) of the first member (21) (93) and the distal end of the vertical portion (34*b*) of the rear wall (34) of the second header forming portion (27) of the first member (21) (93) abut respectively. Therefore, the engagement portions (127) are formed at a plurality of positions in the longitudinal direction of the second member (25) such that they are separated from one another. The other structural features are identical with those of the second member (22) (94) of the above-described embodiment.

In the case of a second member (130) shown in FIGS. 19 and 20, each of the first header forming portion (44) and the second header forming portion (45) has a plurality of circular outward bulging portions (131) formed on an outside portion of the corresponding header forming portion with respect to the front-rear direction such that they are separated from one another with respect to the longitudinal direction of the corresponding header forming portion. Vertically inner portions (portions facing the first member (21) (93)) of the outward bulging portions (131) serve as engagement portions (132), against which the distal end of the vertical portion (31*b*) of the front wall (31) of the first header forming portion (26) of the first member (21) (93) and the distal end of the vertical portion (34*b*) of the rear wall (34) of the second header forming portion (27) of the first member (21) (93) abut respectively. Therefore, the engagement portions (132) are formed at a plurality of positions in the longitudinal direction of the second member (130) such that they are separated from one another.

Further, each of the first header forming portion (44) and the second header forming portion (45) has a plurality of strip-shaped inward bulging portions (133) formed such that they extend from an outside portion to an inside portion of the corresponding header forming portion with respect to the front-rear direction and are separated from one another with respect to the longitudinal direction of the corresponding header forming portion. The other structural features are identical with those of the second member (22) (94) of the above-described embodiment.

In the case where a second member (135) shown in FIGS. 21 and 22 is used in the refrigerant inlet/outlet header tank (2), on the front partition portion (41), which divides the interior of the refrigerant inlet header section (5) into the upper and lower spaces (5*a*) and (5*b*), a plurality of bulging portions (136) are integrally formed at predetermined intervals in the left-right direction such that the bulging portions (136) project downward (toward the heat exchange tubes (15)) and each have a flat bulging end wall (136*a*). Of all the bulging portions (136), those at proper locations have refrigerant-passage through holes (137) formed in their bulging end walls (136*a*). Each bulging portion (136) is formed between two adjacent heat exchange tubes (15).

Notably, when the second member (135) is used in the refrigerant turn tank (3), on the rear partition portion (42), which divides the interior of the second intermediate header section (12) into the upper and lower spaces (12*a*) and (12*b*), a plurality of bulging portions (136) are integrally formed at predetermined intervals in the left-right direction such that the bulging portions (136) project upward (toward the heat exchange tubes (15)) and each have a flat bulging end wall (136*a*). Of all the bulging portions (136), those at proper locations have refrigerant-passage through holes (137) formed in their bulging end walls (136*a*). Each bulging portion (136) is formed between two adjacent heat exchange tubes (15). The other structural features are identical with those of the second member (22) (94) of the above-described embodiment.

In the case where a second member (160) shown in FIGS. 23 and 24 is used in the refrigerant inlet/outlet header tank (2), in an intermediate portion (with respect to the front-rear direction) of the front partition portion (41), which divides the interior of the refrigerant inlet header section (5) into the upper and lower spaces (5*a*) and (5*b*), a plurality of refrigerant-passage circular through holes (161) are formed at predetermined intervals in the left-right direction so as to establish communication between the upper and lower spaces (5*a*) and (5*b*) of the refrigerant inlet header section (5). Guide portions (162) in the form of a quarter-sphere are integrally formed on the lower surface (the surface facing the heat exchange tubes (15)) of the front partition portion (41) at positions corresponding to the through holes (161) such that the guide portions (162) project from portions of the circumferential edges of the corresponding through holes (161), the portions being located on the upstream sides of the through holes with respect to the flow direction of refrigerant in the upper space (5*a*) of the refrigerant inlet header section (5) (a space of the header section in which the refrigerant flows into the heat exchange tubes, the space being opposite the heat exchange tubes). The guide portions (162) are curved downward toward the left. Each through hole (161) and the corresponding guide (162) are formed between two adjacent heat exchange tubes (15). The other structural features are identical with those of the second member (22) (94) of the above-described embodiment.

Notably, although not illustrated in the drawings, the second member (160) may be used in the refrigerant turn tank (3). In this case, in the rear partition portion (42), which divides the interior of the second intermediate header section (12) into the upper and lower spaces (12*a*) and (12*b*), a plurality of circular refrigerant-passage through holes (161) are formed at predetermined intervals in the left-right direction so as to establish communication between the upper and lower spaces (12*a*) and (12*b*) of the second intermediate header section (12). Guide portions (162) in the form of a quarter-sphere are integrally formed on the upper surface (the surface facing the heat exchange tubes (15)) of the rear partition portion (42) at positions corresponding to the through holes (161) such that the guide portions (162) project from portions of the circumferential edges of the corresponding through holes (161), the portions being located on the upstream sides of the through holes with respect to the flow direction of refrigerant in the lower space (12*b*) of the second intermediate header section (12) (a space of the header section in which the refrigerant flows into the heat exchange tubes, the space being opposite the heat exchange tubes). The guide portions (162) are curved downward toward the left.

In the case where a second member (195) shown in FIGS. 25 and 26 is used in the refrigerant inlet/outlet header tank (2), in an intermediate portion (with respect to the front-rear direction) of the front partition portion (41), which divides the interior of the refrigerant inlet header section (5) into the upper and lower spaces (5*a*) and (5*b*), a plurality of refrigerant-passage circular through holes (196) are formed at predetermined intervals in the left-right direction so as to establish communication between the upper and lower spaces (5*a*) and (5*b*) of the refrigerant inlet header section (5). Guide portions (197) in the form of a quarter-sphere are integrally formed on the upper surface (the surface facing opposite the heat exchange tubes (15)) of the front partition portion (41) at positions corresponding to the through holes (196) such that the guide portions (197) project from portions of the circumferential edges of the corresponding through holes (196), the portions being located on the downstream sides of the through holes with respect to the flow direction of refrigerant in the upper space (5*a*) of the refrigerant inlet header section (5) (a space of the header section in which the refrigerant flows into the heat exchange tubes, the space being opposite the heat exchange tubes). The guide portions (197) are curved upward toward the right. Each through hole (196) and the corresponding guide (197) are formed between two adjacent heat exchange tubes (15). The other structural features are identical with those of the second member (22) (94) of the above-described embodiment.

Notably, although not illustrated in the drawings, the second member (195) may be used in the refrigerant turn tank (3). In this case, in the rear partition portion (42), which divides the interior of the second intermediate header section (12) into the upper and lower spaces (12*a*) and (12*b*), a plurality of circular refrigerant-passage through holes (196) are formed at predetermined intervals in the left-right direction so as to establish communication between the upper and lower spaces (12*a*) and (12*b*) of the second intermediate header section (12). Guide portions (197) in the form of a quarter-sphere are integrally formed on the lower surface (the surface facing opposite the heat exchange tubes (15)) of the rear partition portion (42) at positions corresponding to the through holes (196) such that the guide portions (197) project from portions of the circumferential edges of the corresponding through holes (196), the portions being located on the downstream sides of the through holes with respect to the flow direction of refrigerant in the lower space (12*b*) of the second intermediate header section (12) (a space of the header section in which the refrigerant flows into the heat exchange tubes, the space being opposite the heat exchange tubes). The guide portions (197) are curved downward toward the right.

In the case where a second member (165) shown in FIGS. 27 and 28 is used in the refrigerant inlet/outlet header tank (2), hemispherical bulging portions (166) are integrally formed on the front partition portion (41), which divides the interior of the refrigerant inlet header section (5) into the upper and lower spaces (5*a*) and (5*b*), such that the bulging portions (166) project downward (toward the heat exchange tubes (15)). Of all the bulging portions (141), bulging portions (166) at proper locations have a plurality of refrigerant-passage through holes (167) radially formed therein. Each bulging portion (166) is formed between two adjacent heat exchange tubes (15). The other structural features are identical with those of the second member (22) (94) of the above-described embodiment.

Notably, although not illustrated in the drawings, the second member (165) may be used in the refrigerant turn tank (3). In this case, hemispherical bulging portions (166) are integrally formed on the rear partition portion (42), which divides the interior of the second intermediate header section (12) into the upper and lower spaces (12*a*) and (12*b*), such that the bulging portions (166) project upward (toward the heat exchange tubes (15)). Of all the bulging portions (166), bulging portions (166) at proper locations have a plurality of refrigerant-passage through holes (167) radially formed therein. Each bulging portion (166) is formed between two adjacent heat exchange tubes (15).

In the case where a second member (170) shown in FIGS. 29 and 30 is used in the refrigerant inlet/outlet header tank (2), on the front partition portion (41), which divides the interior of the refrigerant inlet header section (5) into the upper and lower spaces (5*a*) and (5*b*), projecting portions (171) each having a V-shaped transverse cross section are integrally formed at predetermined intervals in the left-right direction such that the projecting portions (171) project downward (toward the heat exchange tubes (15)), and extend in the front-rear direction (the width direction of the refrigerant inlet/outlet header tank (2)). Of all the projecting portions (171), those at proper locations have refrigerant-passage through holes (172) formed to extend over opposite wall portions of the projecting portions (171), which wall portions form the V shape. Each projecting portion (171) is formed between two adjacent heat exchange tubes (15). The other structural features are identical with those of the second member (22) (94) of the above-described embodiment.

Notably, although not illustrated in the drawings, the second member (170) may be used in the refrigerant turn tank (3). In this case, on the rear partition portion (42), which divides the interior of the second intermediate header section (12) into the upper and lower spaces (12*a*) and (12*b*), projecting portions (171) each having a V-shaped transverse cross section are integrally formed at predetermined intervals in the left-right direction such that the projecting portions (171) project upward (toward the heat exchange tubes (15)), and extend in the front-rear direction (the width direction of the refrigerant inlet/outlet header tank (2)). Of all the projecting portions (171), those at proper locations have refrigerant-passage through holes (172) formed to extend over opposite wall portions of the projecting portions (171), which wall portions form the V shape. Each projecting portion (171) is formed between two adjacent heat exchange tubes (15).

In the case where a second member (175) shown in FIGS. 31 and 32 is used in the refrigerant inlet/outlet header tank (2), of all the projecting portions (171) having a V-shaped transverse cross section, those at proper locations have refrigerant-passage through holes (176) formed in opposite wall portions of the projecting portions (171), which wall portions form the V-shape. The other structural features are identical with those of the second member (170) shown in FIGS. 29 and 30. Notably, the second member (175) shown in FIGS. 31 and 32 is also used in the refrigerant turn header tank (3) as in the case of the second plate (170) shown FIGS. 29 and 30.

A second member (140) shown in FIG. 33 includes a first header forming portion (141) which forms an upper portion of the refrigerant inlet header section (5) or a lower portion of the first intermediate header section (11); a second header forming portion (142) which forms an upper portion of the refrigerant outlet header section (6) or a lower portion of the second intermediate header section (12); a connection wall (143) (connection portion) which connects the two header forming portions (141) and (142); and front and rear horizontal partition portions (144) and (145) which are provided on the inner side of the two header forming portions (141) and (142).

Each of the two header forming portions (141) and (142) of the second member (140) has a generally U-shaped transverse cross section such that the forming portion opens vertically inward (toward the heat exchange tubes (15), and its central portion with respective to the front-rear direction projects vertically outward. A plurality of outward projecting portions (146) are formed on a front wall portion of the first header forming portion (141) and a rear wall portion of the second header forming portion (142) near the partition portions (144) and (145), respectively, such that they are separated from one another in the longitudinal direction. Vertically inner portions (portions facing the first member (21)) of the outward projecting portions (146) serve as engagement portions (147), against which the distal end of the vertical portion (31*b*) of the front wall (31) of the first header forming portion (26) of the first member (21) and the distal end of the vertical portion (34*b*) of the rear wall (34) of the second header forming portion (27) of the first member (21) abut respectively. Therefore, the engagement portions (147) are formed at a plurality of positions in the longitudinal direction of the second member (140) such that they are separated from one another.

The connection wall (143) between the two header forming portions (141) and (142) of the second member (140) has a plurality of drain through holes (not shown) and a plurality of fixation through holes (148) formed such that they coincide with the drain through holes (37) and the fixation through holes (38) of the connection wall (28) of the first member (21).

A rear edge portion of the front partition portion (144) is obliquely bent downward toward the rear, and a horizontal surface contract portion (151) is formed at the rear edge thereof. The surface contract portion (151) is brazed, in a surface contact state, to a front half of a vertically inner surface (surface facing toward the heat exchange tubes (15)) of the connection wall (143) and a front half of a vertically outer surface of the connection wall (28) of the first member (21). The rear edge of the surface contact portion (151) is located at a position where it does not close the drain through holes and the fixation through holes (148) of the connection wall (143). A plurality of projections (152) are formed at the rear edge of the surface contact portion (151) to be separated from one another in the left-right direction. The projections (152), which extend vertically outward, are inserted into the fixation through holes (148) of the connection wall (143) and are brazed to the connection wall (143) (see FIG. 34). A front edge portion of the rear partition portion (145) is obliquely bent downward toward the front, and a horizontal surface contract portion (153) is formed at the front edge thereof. The surface contract portion (153) is brazed, in a surface contact state, to a rear half of the vertically inner surface (surface facing toward the heat exchange tubes (15)) of the connection wall (143) and a rear half of the vertically outer surface of the connection wall (28) of the first member (21). The front edge of the surface contact portion (153) is located at a position where it does not close the drain through holes and the fixation through holes (148) of the connection wall (143). A plurality of projections (154) are formed at the front edge of the surface contact portion (153) to be separated from one another in the left-right direction. The projections (154), which extend vertically outward, are inserted into the fixation through holes (148) of the connection wall (143) and are brazed to the connection wall (143). The projections (152) and (154) of the two partition portions (144) and (145) are inserted into the fixation through holes (148) alternately in the left-right direction. Although not illustrated in the drawings, a plurality of abutment pieces are integrally formed at the inner edge (with respect to the front-rear direction) of each of the surface contact portions (151) and (153) such that the abutment pieces project toward the other surface contact portion (153) or (151), abut against the other surface contact portion (153) or (151), and are brazed to the other surface contact portion (153) or (151). The abutment pieces are formed at locations shifted from the drain through holes (37) and the fixation through holes (38) and (148) of the first and second members (21) and (22) such that they do not interfere with these through holes (37), (38), and (148).

Although not shown in the drawings, when the second member (140) is used in the refrigerant inlet/outlet header tank (2), the cutout (46), the refrigerant-passage through holes (47), and the flanges (48) are formed in the front partition portion (144), and the refrigerant-passage through holes (51A) and (51B) and the flanges (52A) and (52B) are formed in the rear partition portion (145). Further, when the second member (140) is used in the refrigerant turn header tank (3), the rectangular refrigerant-passage through holes (101) are formed in the front partition portion (144), and the refrigerant-passage through holes (102) and the flanges (103) are formed in the rear partition portion (145).

As shown in FIG. 34, the second member (140) is formed from a blank aluminum brazing sheet having a brazing material layer over opposite surfaces thereof as follows. The outward projecting portions (146), the drain through holes, the fixation through holes (148), the surface contact portions (151) and (153), the projections (152) and (154), and the abutment pieces are formed on the blank sheet. Subsequently, the blank sheet is bent by a suitable method so as to form the first and second header forming portions (141) and (142), the connection wall (143), and the two partition portions (144) and (145). The projections (152) and (154) are then inserted into the fixation through holes (148), and predetermined portions of this semi-finished product are brazed, whereby the second member is completed. Notably, brazing of the predetermined portions of this semi-finished product is performed simultaneously with brazing of other components at the time of manufacture of the evaporator (1). When the second member (140) is used in the refrigerant inlet/outlet header tank (2), the cutout (46), the circular through holes (47), the flanges (48), the elliptical through holes (51A) and (51B), and the flanges (52A) and (52B) are formed before the blank sheet is bent. When the second member (140) is used in the refrigerant turn header tank (3), the through holes (101), the through holes (102), and the flanges (103) are formed before the blank sheet is bent.

A second member (180) shown in FIGS. 35 and 36 includes a first header forming portion (181) which forms an upper portion of the refrigerant inlet header section (5) or a lower portion of the first intermediate header section (11); a second header forming portion (182) which forms an upper portion of the refrigerant outlet header section (6) or a lower portion of the second intermediate header section (12); a connection wall (183) (connection portion) which connects the two header forming portions (181) and (182); and front and rear horizontal plate-shaped partition portions (184) and (185) which are provided on the vertically inner side of the two header forming portions (181) and (182).

Each of the two header forming portions (181) and (182) of the second member (180) has a generally U-shaped transverse cross section such that the forming portion opens vertically inward (toward the heat exchange tubes (15), and its central portion with respective to the front-rear direction projects vertically outward.

The connection wall (183) between the two header forming portions (181) and (182) of the second member (180) has a plurality of drain through holes (186) and a plurality of fixation through holes (187) formed such that they coincide with the drain through holes (37) and the fixation through holes (38) of the connection wall (28) of the first member (21).

The front partition portion (184) and the rear partition portion (185) are connected together by a horizontal connection wall (188) (connection portion) located in a common horizontal plane in which the two partition portions (184) and (185) are located. The connection wall (188) is brazed, in a surface contact state, to a vertically inner surface (surface facing toward the heat exchange tubes (15)) of the connection wall (183) and a vertically outer surface of the connection wall (28) of the first member (21). The connection wall (188) has a plurality of drain through holes (189) and a plurality of fixation through holes (191) formed such that they coincide with the drain through holes (186) and the fixation through holes (187) of the connection wall (183). A front edge portion (edge portion located on the outer side with respective to the front-rear direction) of the front partition portion (184) is integrally connected to a front edge portion (edge portion located on the outer side with respective to the front-rear direction) of the front header forming portion (181). The rear partition portion (185) has an engagement portion (192) at a rear edge portion (edge portion located on the rear side with respective to the front-rear direction). The engagement portion (192) extends vertically outward, is engaged with an outer surface of the rear wall of the rear header forming portion (182), and is brazed thereto.

The connection wall (28) of the first member (21), the connection wall (183) between the two header forming portions (181) and (182) of the second member (180), and the connection wall (188) between the two partition portions (184) and (185) of the second member (180) are brazed together in a state in which these walls are provisionally fixed by a strip-shaped fixing member (193) having fixing legs (193*a*) inserted into the fixation through holes (38), (187), and (191) from above.

Although not shown in the drawings, when the second member (180) is used in the refrigerant inlet/outlet header tank (2), the cutout (46), the refrigerant-passage through holes (47), and the flanges (48) are formed in the front partition portion (184), and the refrigerant-passage through holes (51A) and (51B) and the flanges (52A) and (52B) are formed in the rear partition portion (185). Further, when the second member (180) is used in the refrigerant turn header tank (3), the rectangular refrigerant-passage through holes (101) are formed in the front partition portion (184), and the refrigerant-passage through holes (102) and the flanges (103) are formed in the rear partition portion (185).

As shown in FIGS. 37 and 38, the second member (180) is formed from a blank aluminum brazing sheet having a brazing material layer over opposite surfaces thereof as follows. After formation of the drain through holes (186) and (189), and the fixation through holes (187) and (191), and the engagement portion (192), the blank sheet is bent by a suitable method so as to form the first and second header forming portions (181) and (182), the connection wall (183), the two partition portions (184) and (185), and the connection wall (188). Further, the engagement portion (192) is engaged with the outer surface of the rear wall of the rear header forming portion (182), whereby a semi-finished product is formed. Predetermined portions of this semi-finished product are brazed, whereby the second member is completed. Although brazing of the predetermined portions of this semi-finished product is performed simultaneously with brazing of other components at the time of manufacture of the evaporator (1), brazing between predetermined portions of the first member (21) and predetermined portions of the second member (180) is performed after the second member (180) and the first member (21) are provisionally fixed together by means of inserting the fixing legs (193*a*) of the fixing member (193) into the fixing through holes (187) and (191) and the fixing through holes (38) of the first member (21) followed by crimping. When the second member (180) is used in the refrigerant inlet/outlet header tank (2), the cutout (46), the circular through holes (47), the flanges (48), the elliptical through holes (51A) and (51B), and the flanges (52A) and (52B) are formed before the blank sheet is bent. When the second member (180) is used in the refrigerant turn header tank (3), the through holes (101), the through holes (102), and the flanges (103) are formed before the blank sheet is bent.

In the above-described embodiment, the heat exchanger of the present invention is applied to an evaporator of a car air conditioner using a chlorofluorocarbon-based refrigerant. However, the present invention is not limited thereto. The heat exchanger of the present invention may be used as an evaporator of a car air conditioner used in a vehicle, for example, an automobile, the car air conditioner including a compressor, a gas cooler (serving as a refrigerant cooler), an intermediate heat exchanger, an expansion valve, and an evaporator and using a supercritical refrigerant such as a $CO_2$ refrigerant.

Industrial Applicability

The heat exchanger is preferably used as an evaporator of a car air conditioner, which is a refrigeration cycle to be mounted on, for example, an automobile.

Figure 1:
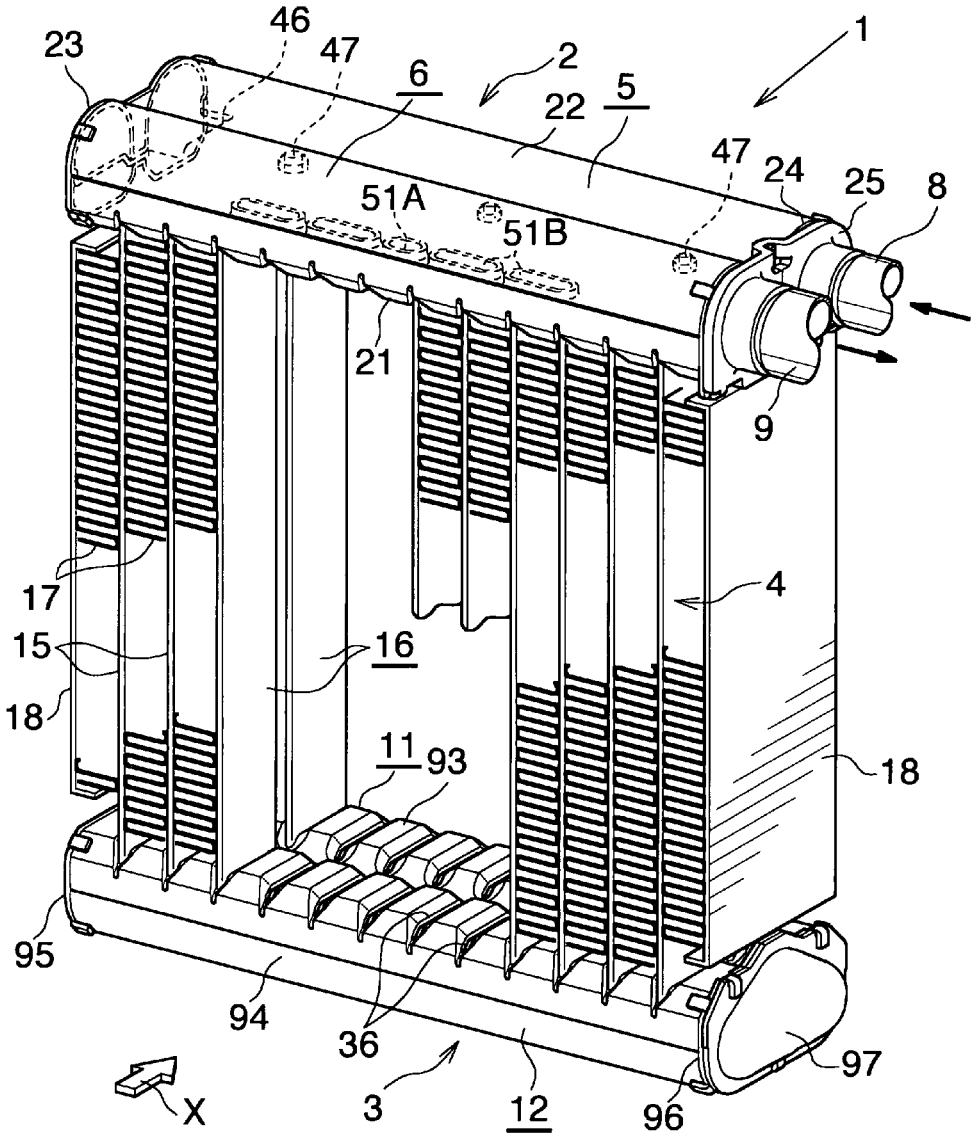
FIG. 1 is a partially cut-away perspective view showing the overall configuration of an evaporator to which a heat exchanger according to the present invention is applied.
Figure 2:
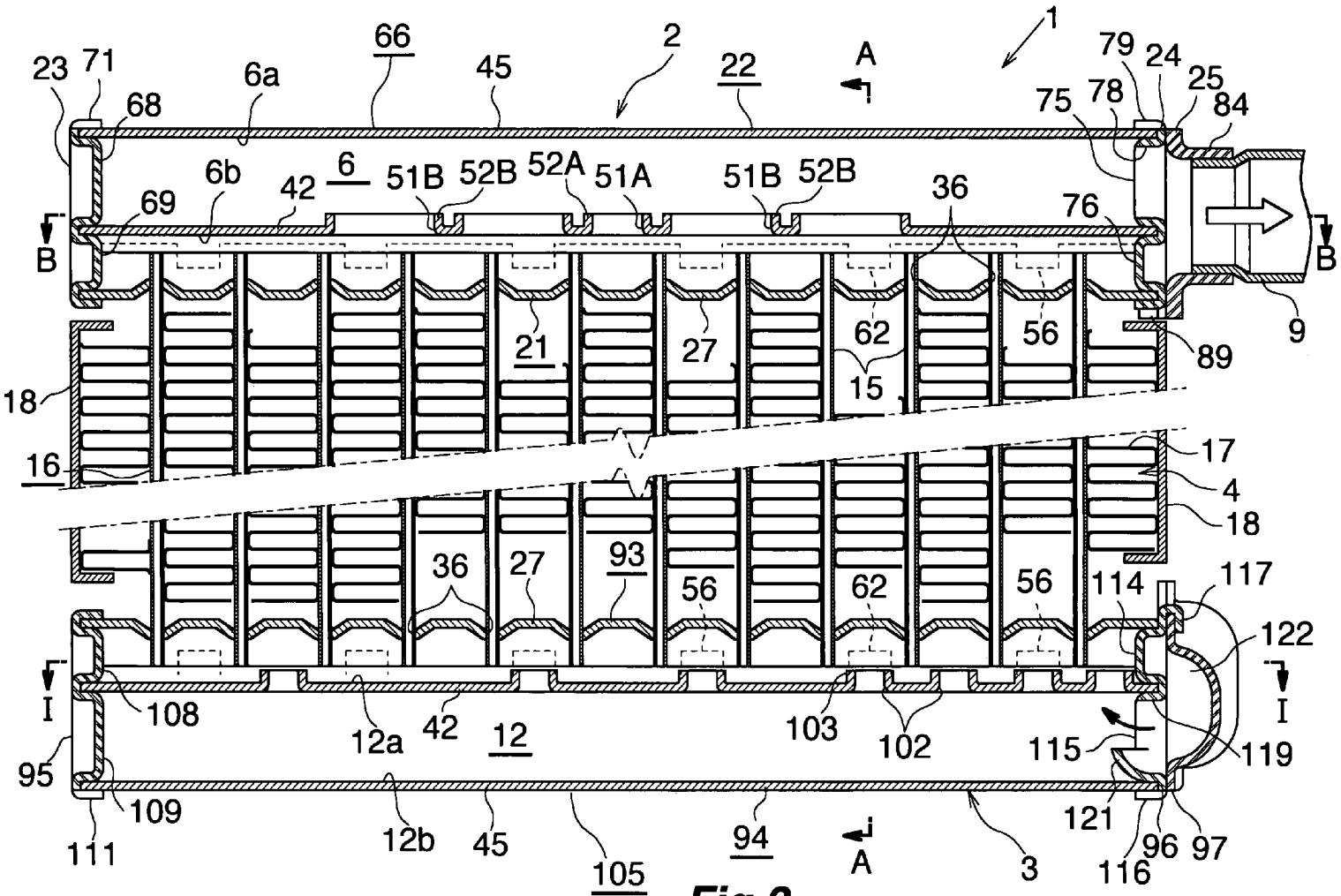
FIG. 2 is a vertical cross sectional view of the evaporator of FIG. 1 as it is seen from the rear, with its intermediate portion omitted.
Figure 3:
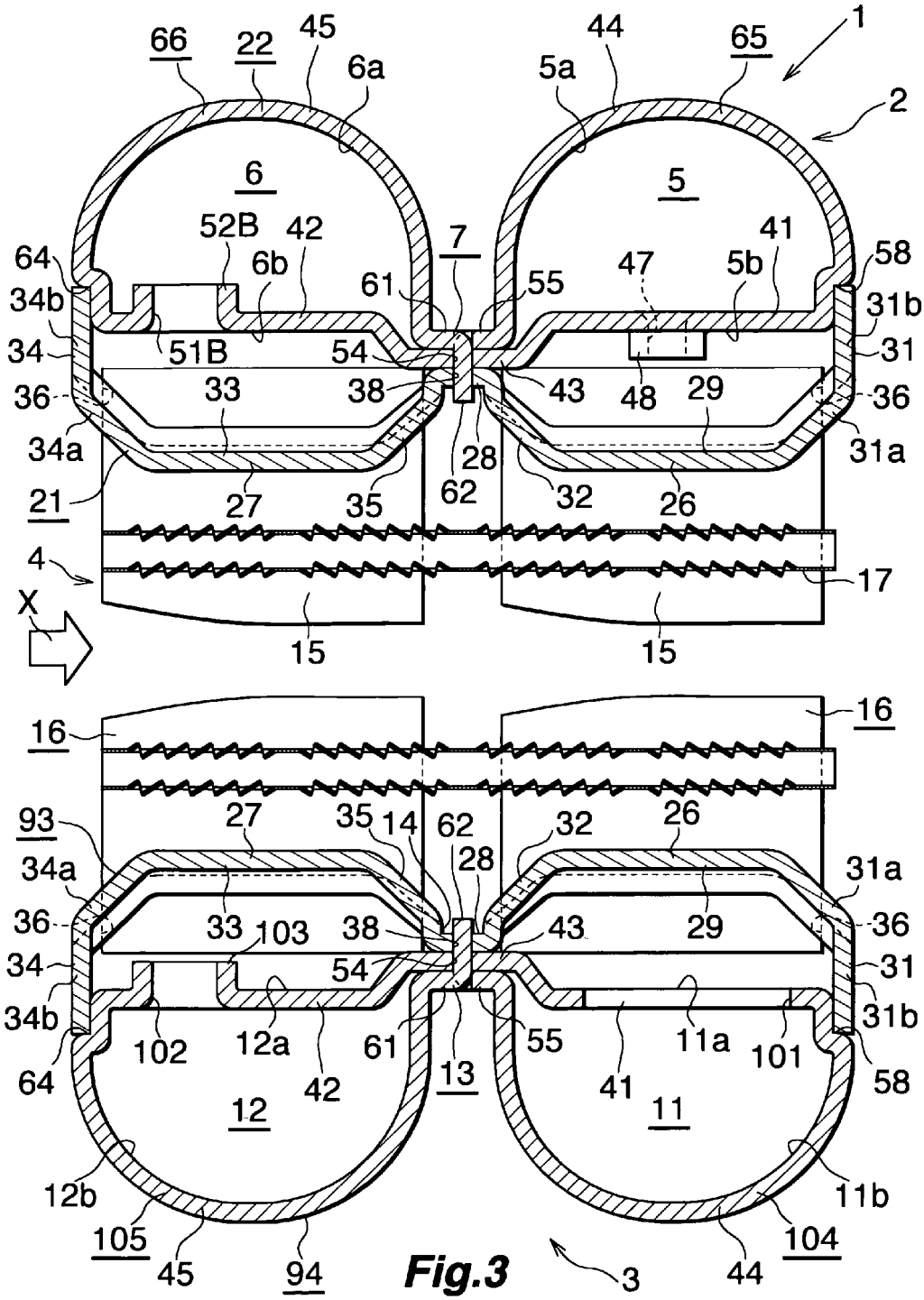
FIG. 3 is a partially-omitted, enlarged cross sectional view taken along line A-A of FIG. 2.
Figure 4:
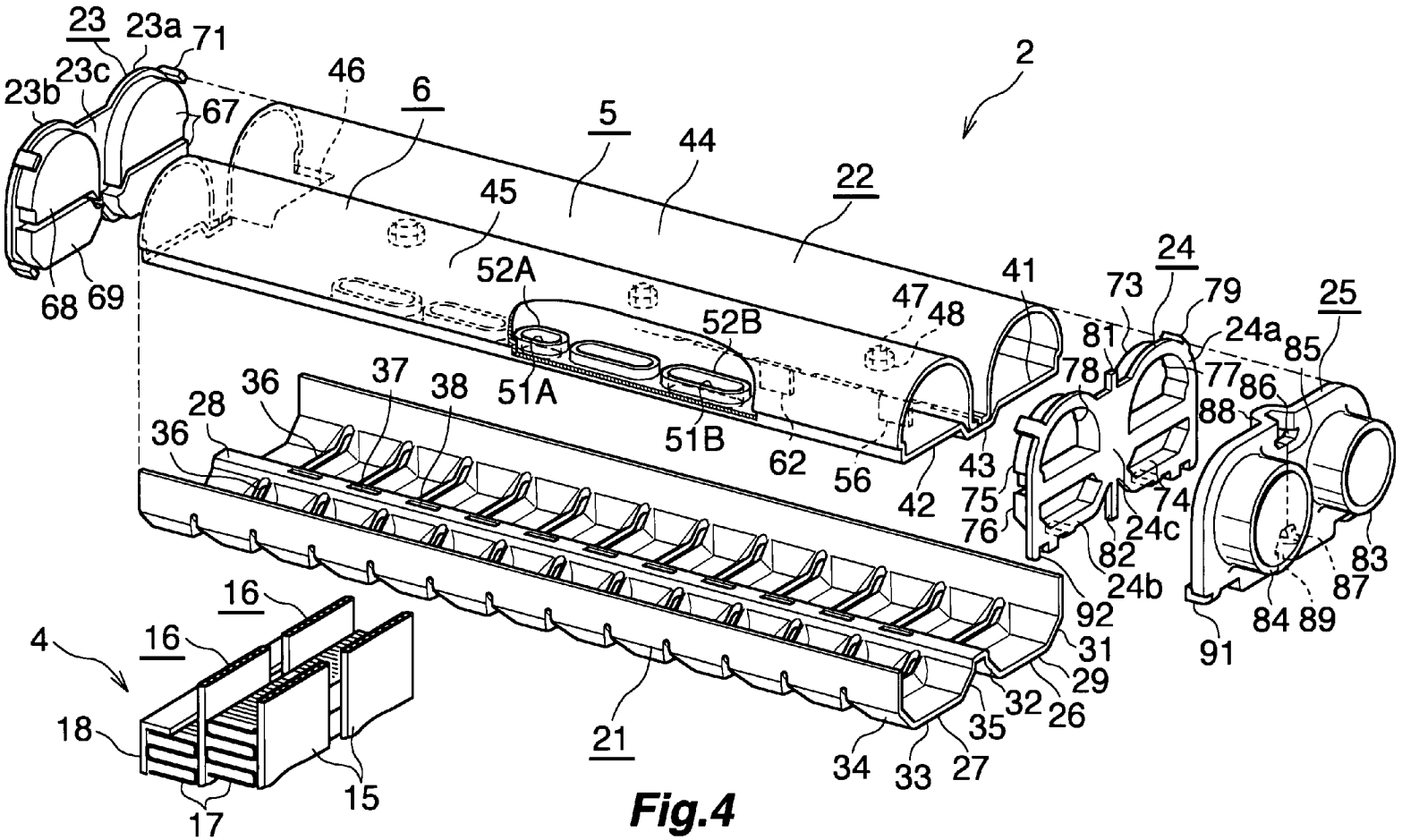
FIG. 4 is an exploded perspective view of a refrigerant inlet/outlet header tank of the evaporator shown in FIG. 1.
Figure 5:
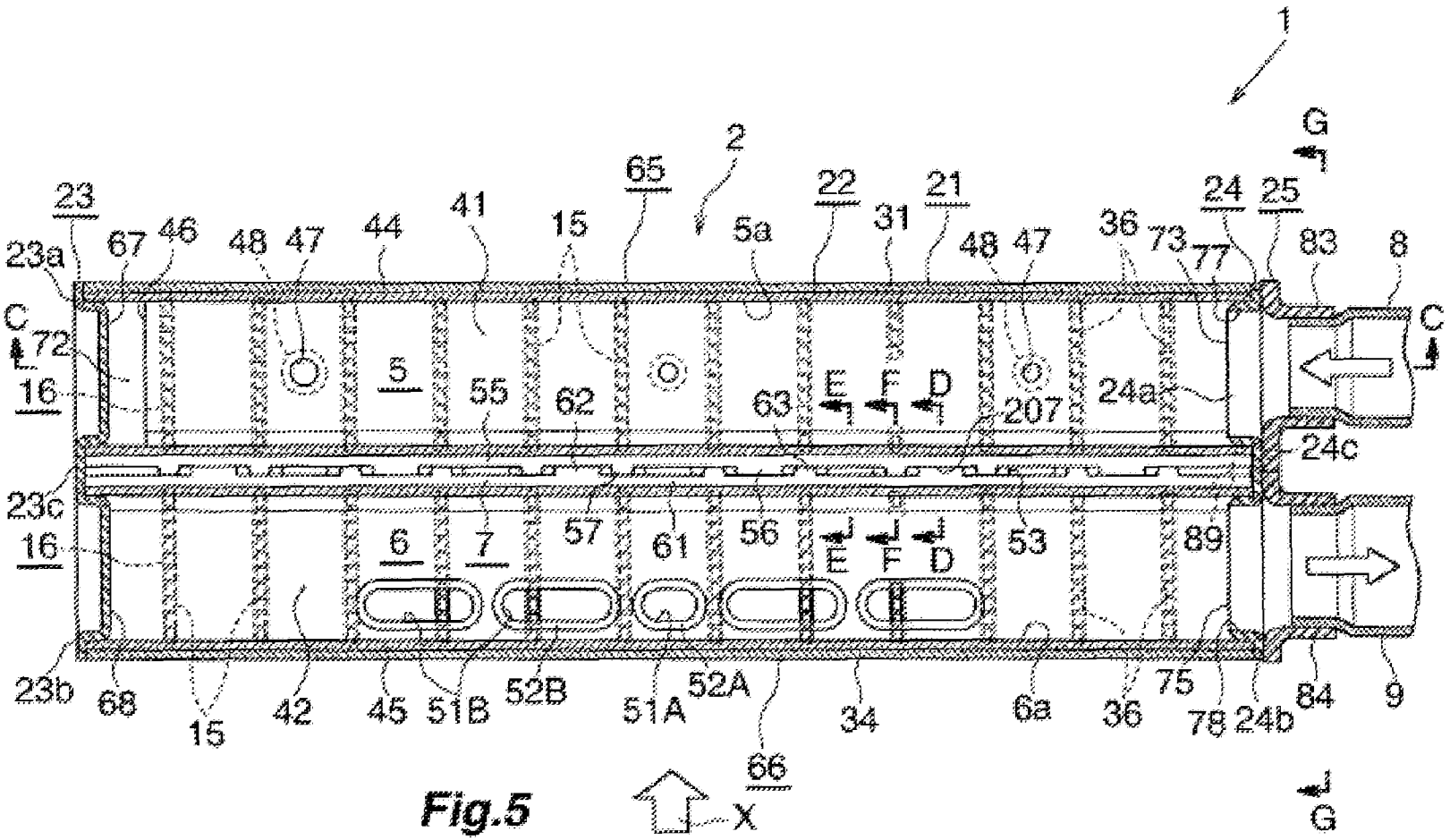
FIG. 5 is a cross sectional view taken along line B-B of FIG. 2.
Figure 6:
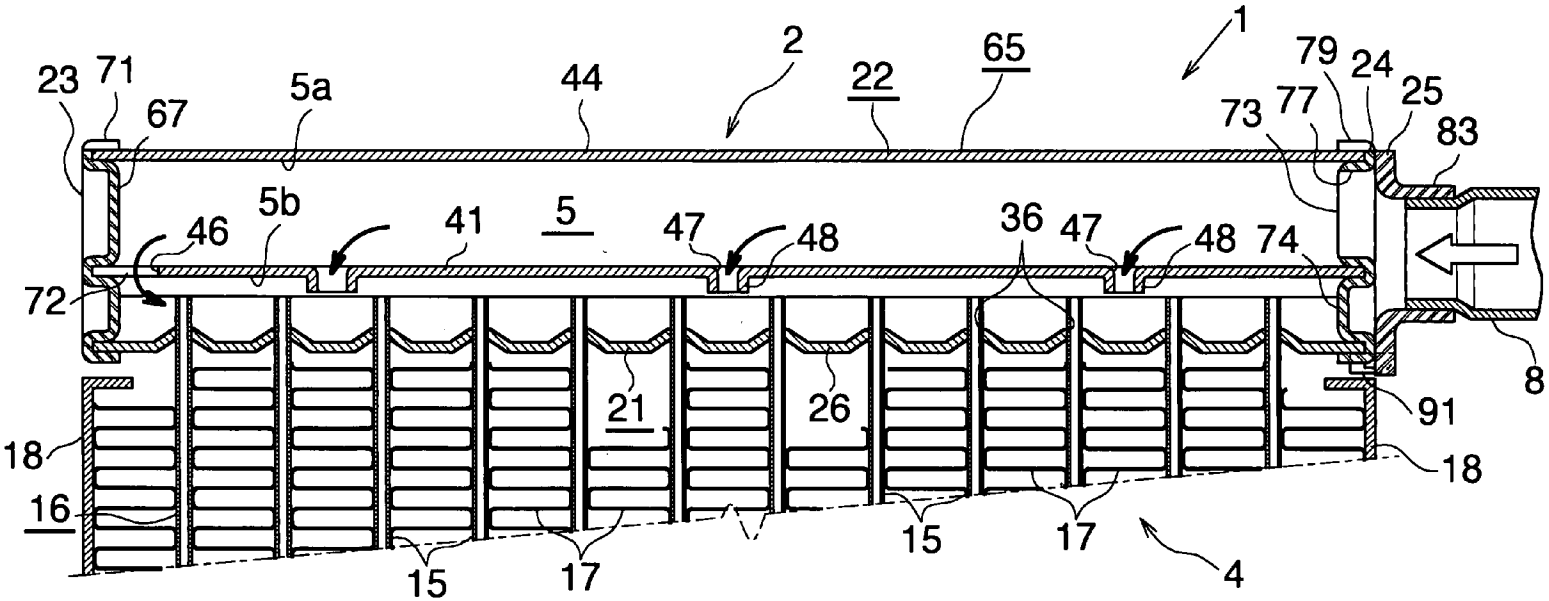
FIG. 6 is a cross sectional view taken along line C-C FIG. 5.
Figure 7:
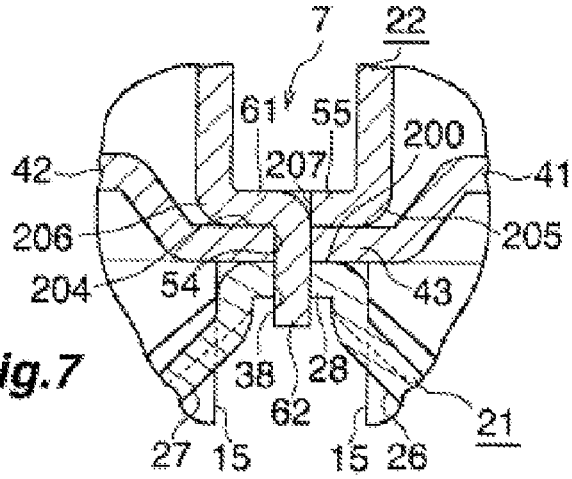
FIG. 7 is an enlarged cross sectional view taken along line DD of FIG. 5.
Figure 8:
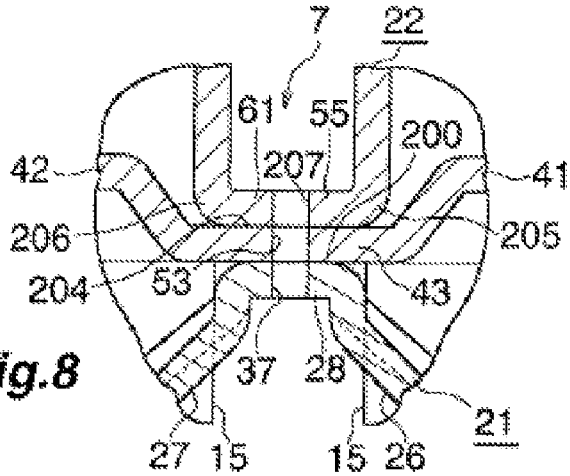
FIG. 8 is an enlarged cross sectional view taken along line E-E of FIG. 5.
Figure 9:
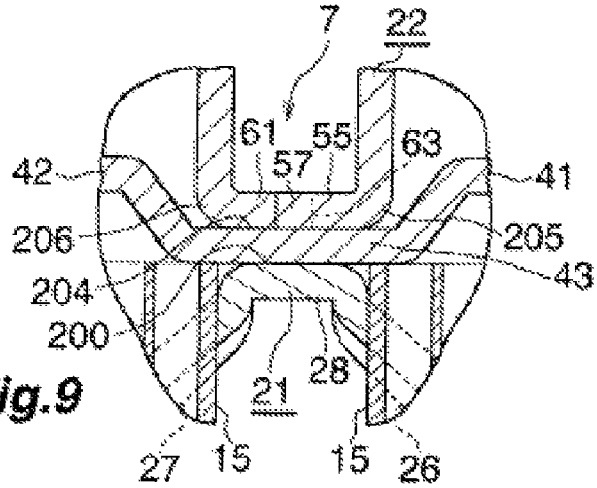
FIG. 9 is an enlarged cross sectional view taken along line F-F of FIG. 5.
Figure 10:
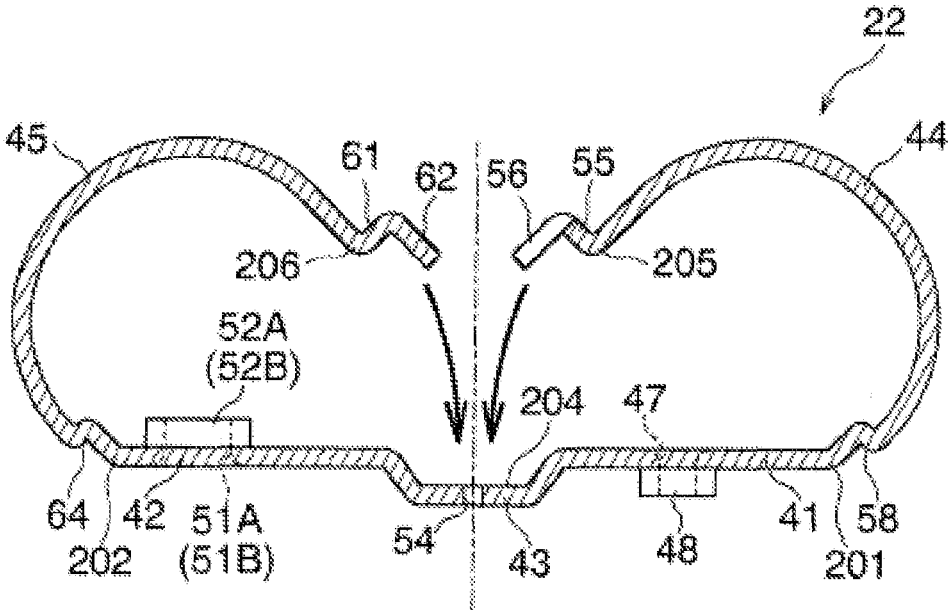
FIG. 10 is a transverse cross sectional view showing a step of a method of manufacturing a second member of a refrigerant inlet/outlet header tank.
Figure 11:
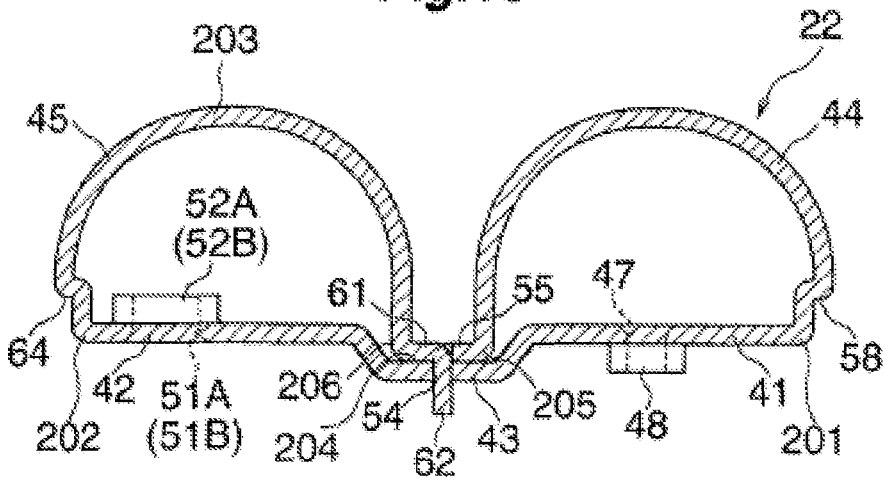
FIG. 11 is a transverse cross sectional view showing a step of the method of manufacturing the second member of the refrigerant inlet/outlet header tank, the step being different from the step of FIG. 10.
Figure 12:
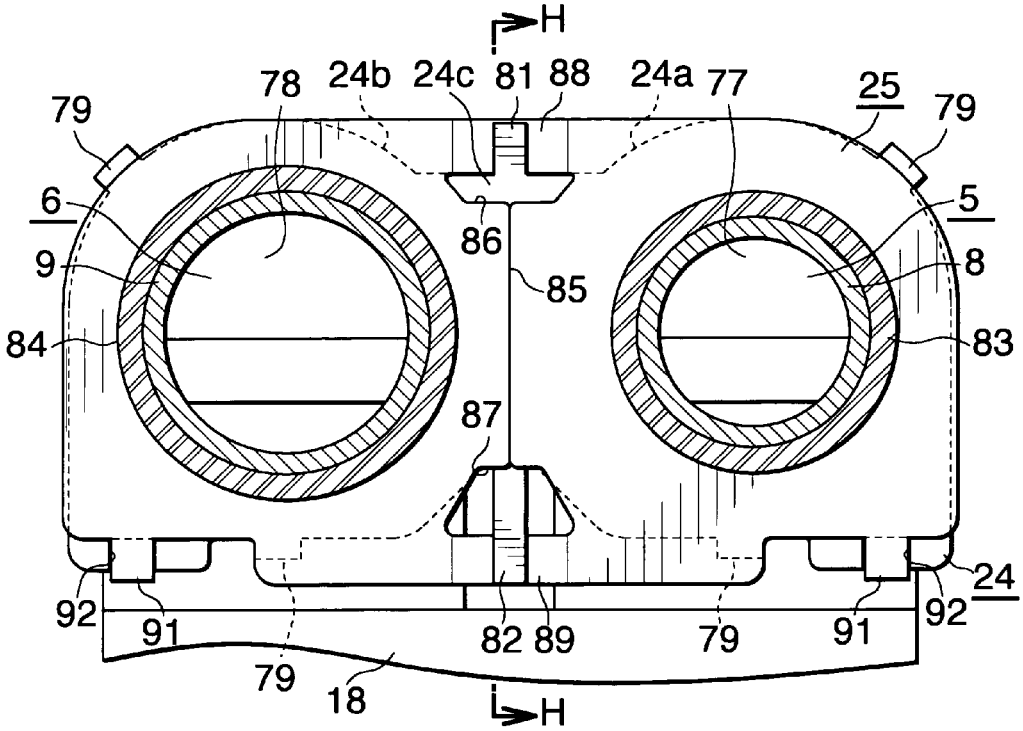
FIG. 12 is an enlarged cross sectional view taken along line G-G of FIG. 5.
Figure 13:
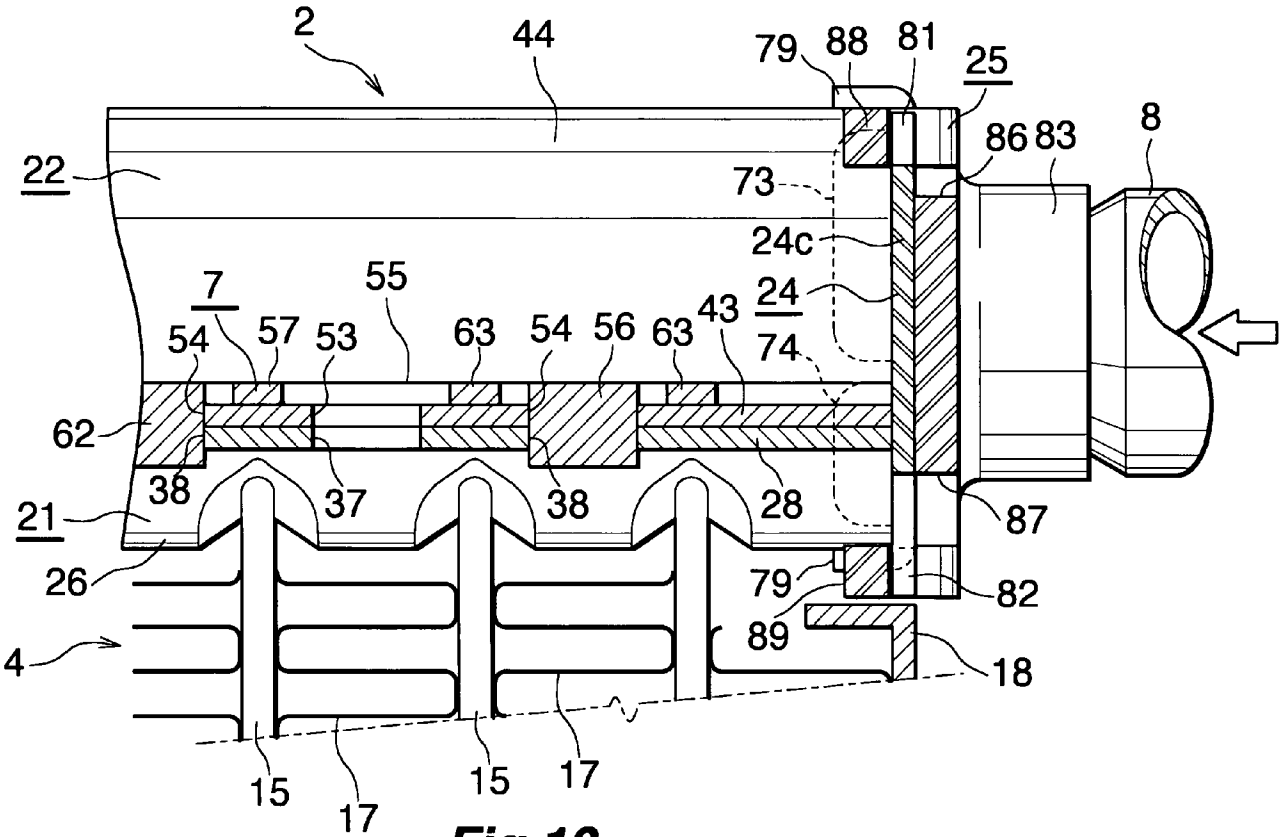
FIG. 13 is a cross sectional view taken along line H-H of FIG. 12.
Figure 14:
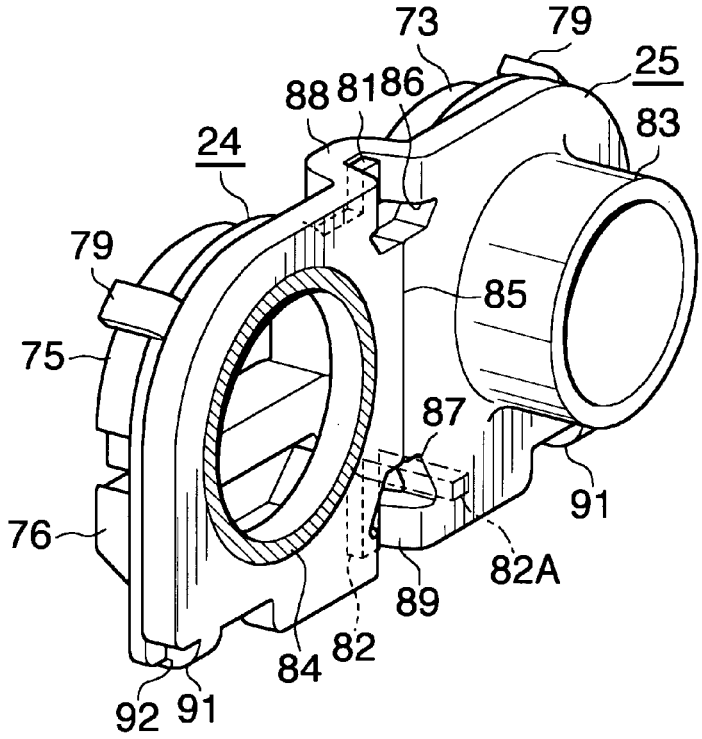
FIG. 14 is a partially cut-away perspective view showing a right end member and a joint plate of the refrigerant inlet/outlet header tank of the evaporator shown in FIG. 1.
Figure 15:
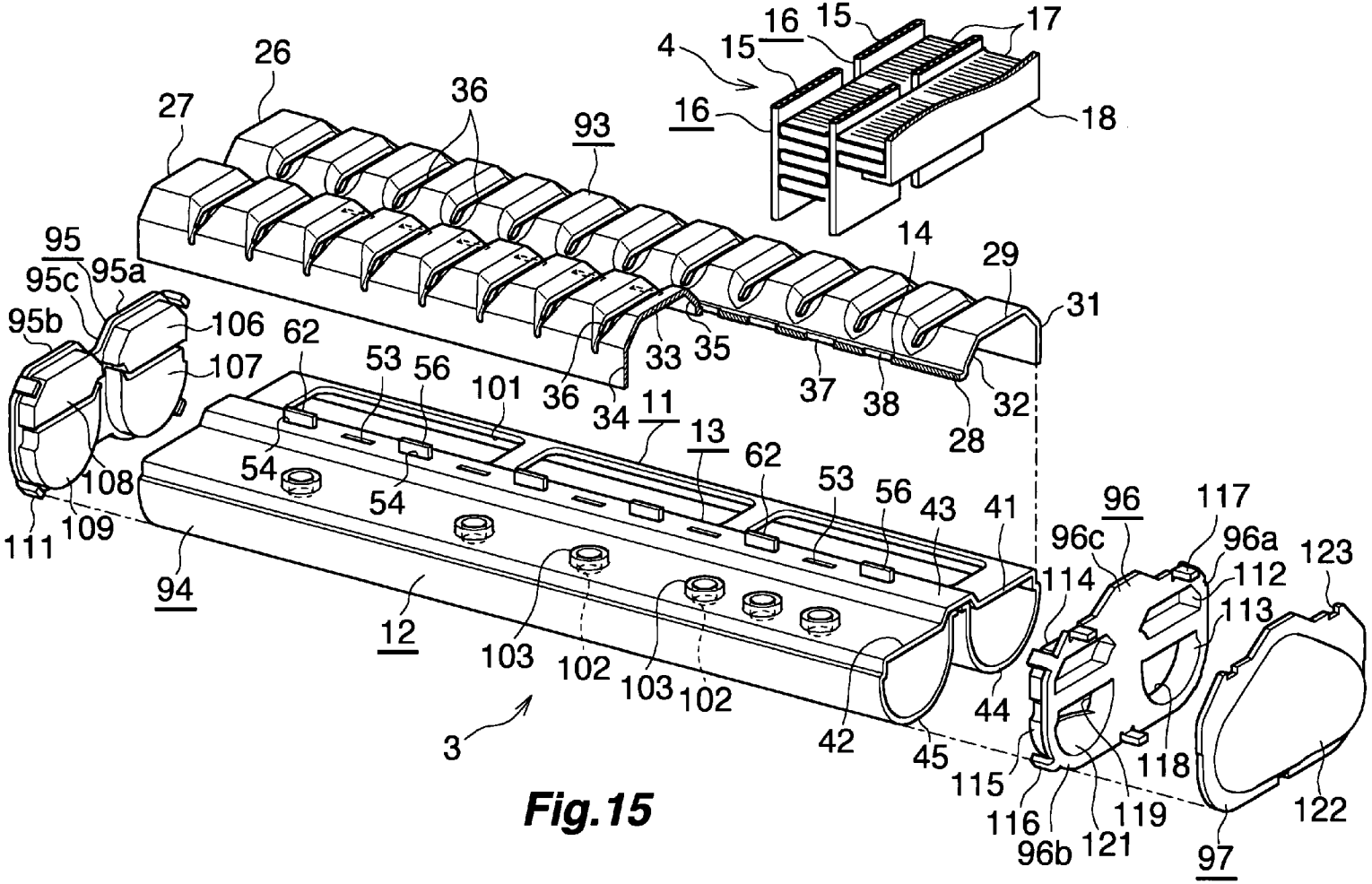
FIG. 15 is an exploded perspective view of a refrigerant turn header tank of the evaporator shown in FIG. 1.
Figure 16:
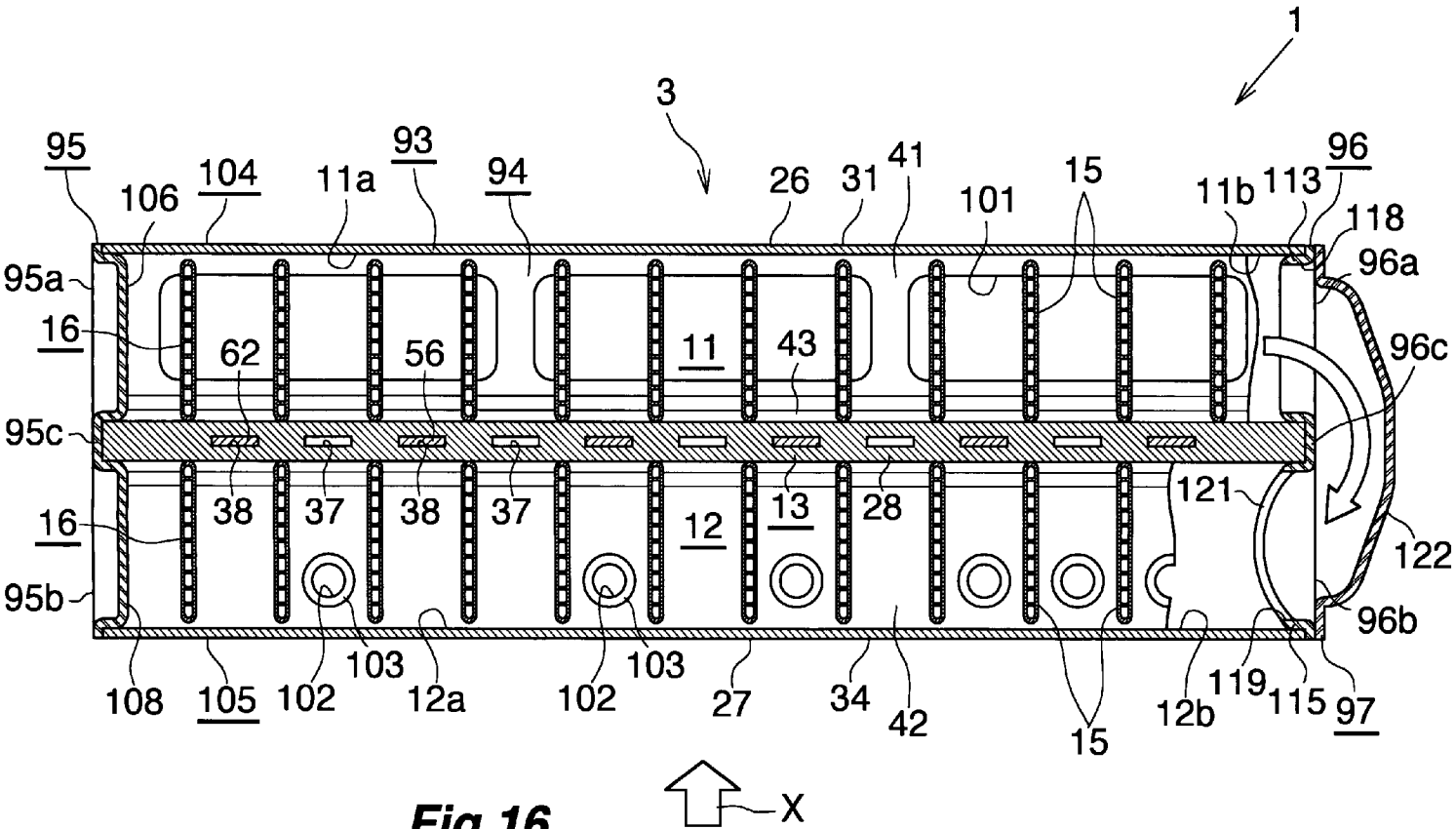
FIG. 16 is a partially cut-away cross sectional view taken along line I-I of FIG. 2.
Figure 17:
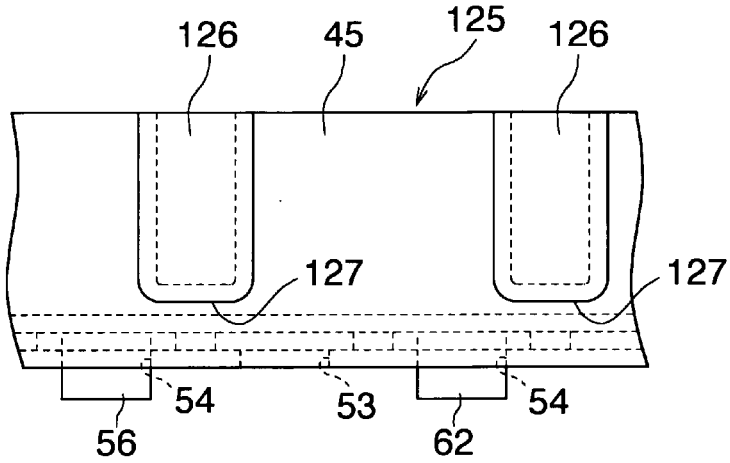
FIG. 17 is a partial front view showing a first modification of the second member.
Figure 18:
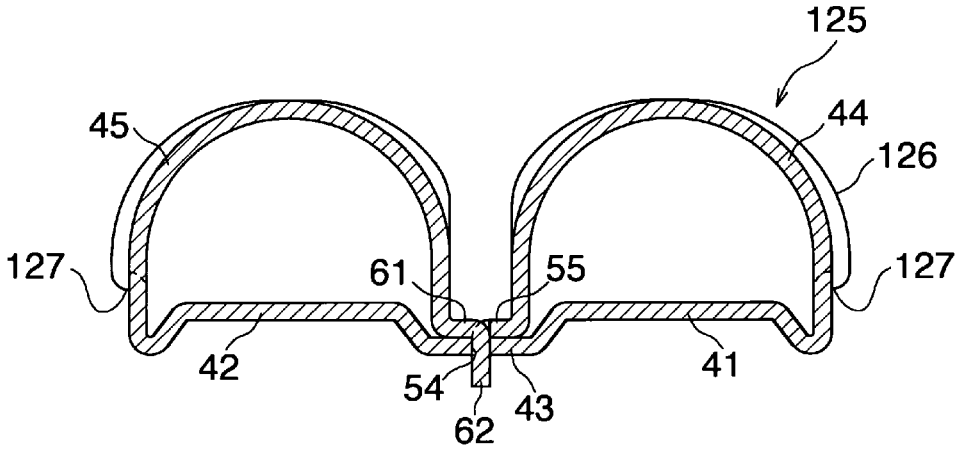
FIG. 18 is a transverse cross sectional view showing the first modification of the second member.
Figure 19:
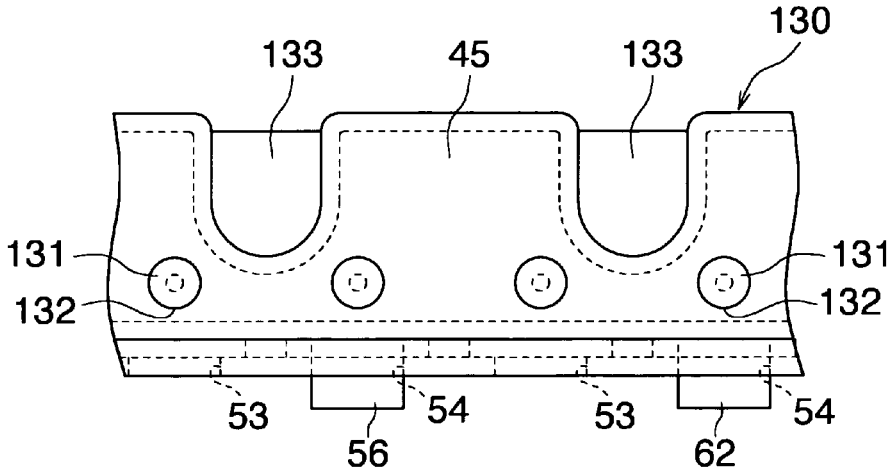
FIG. 19 is a partial front view showing a second modification of the second member.
Figure 20:
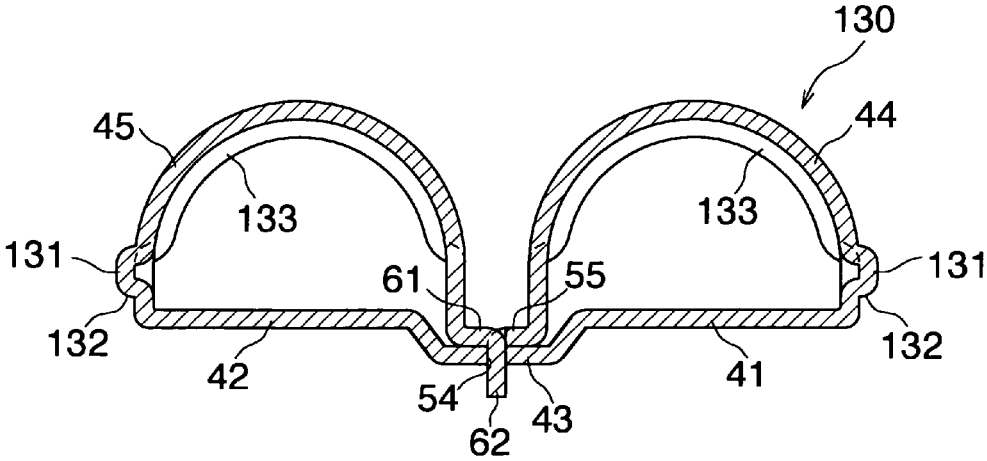
FIG. 20 is a transverse cross sectional view showing the second modification of the second member.
Figure 21:
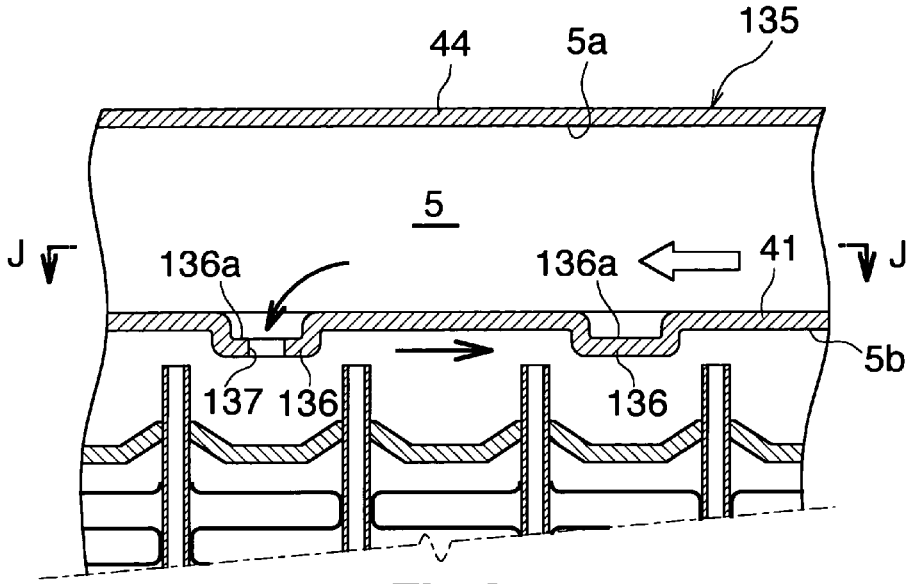
FIG. 21 is a view corresponding to the main portion of FIG. 6 and showing a portion of an evaporator using a third modification of the second member.
Figure 22:
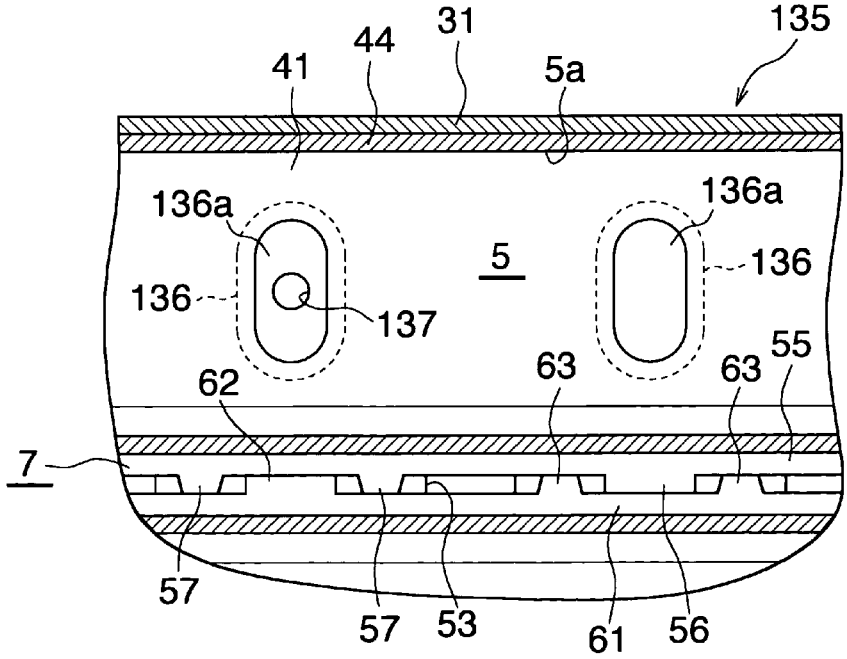
FIG. 22 is a cross sectional view taken along line J-J of FIG. 21.
Figure 23:
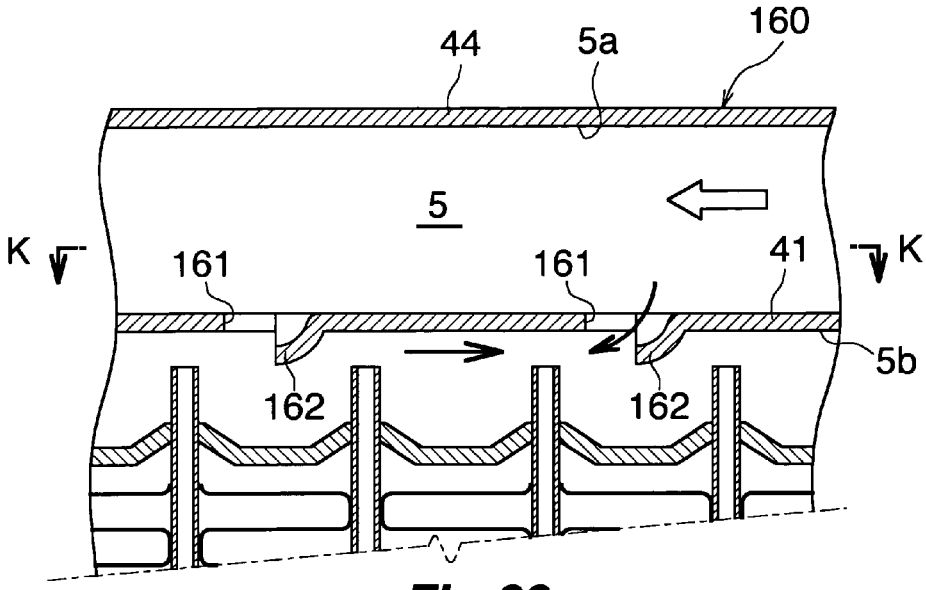
FIG. 23 is a view corresponding to the main portion of FIG. 6 and showing a portion of an evaporator using a fourth modification of the second member.
Figure 24:
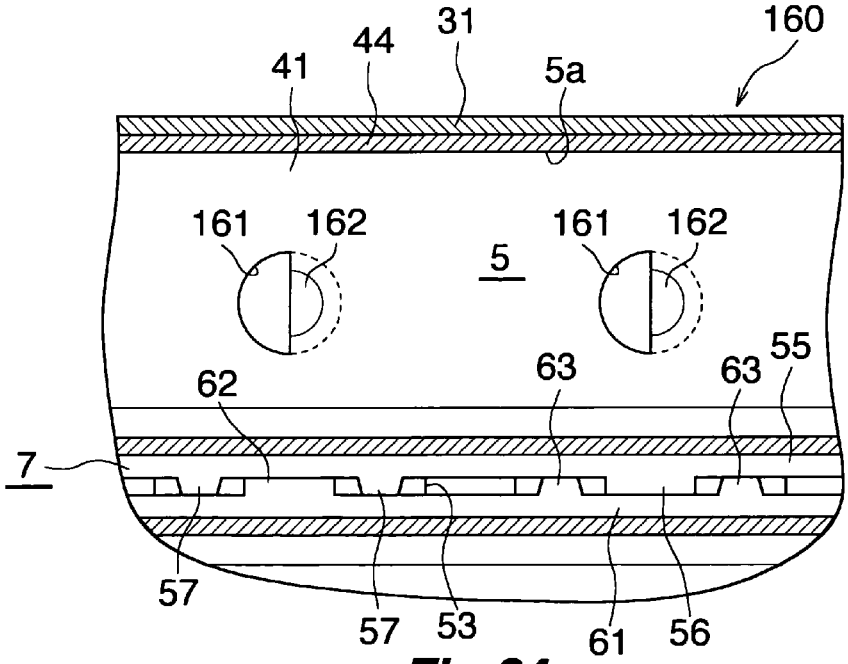
FIG. 24 is a cross sectional view taken along line K-K of FIG. 23.
Figure 25:
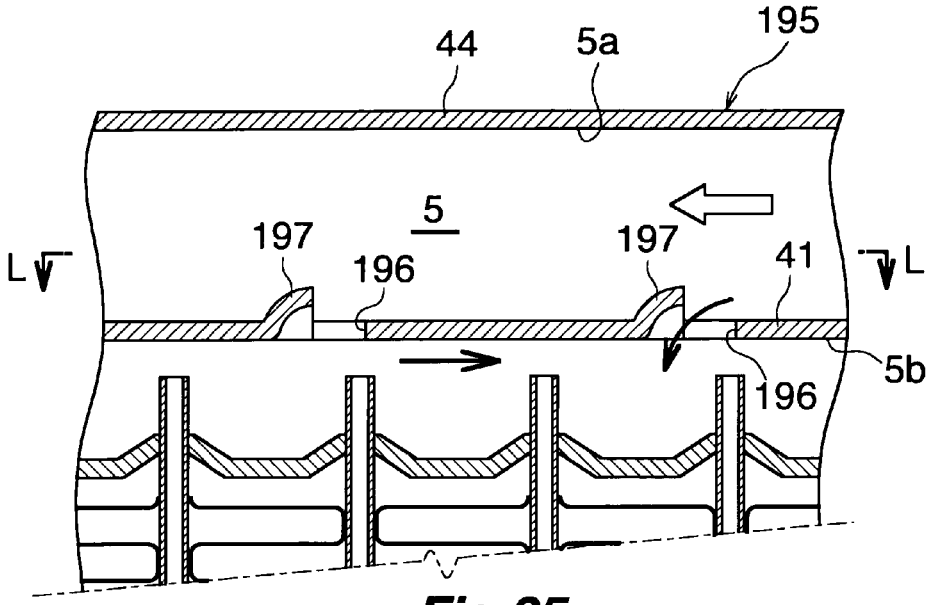
FIG. 25 is a view corresponding to the main portion of FIG. 6 and showing a portion of an evaporator using a fifth modification of the second member.
Figure 26:
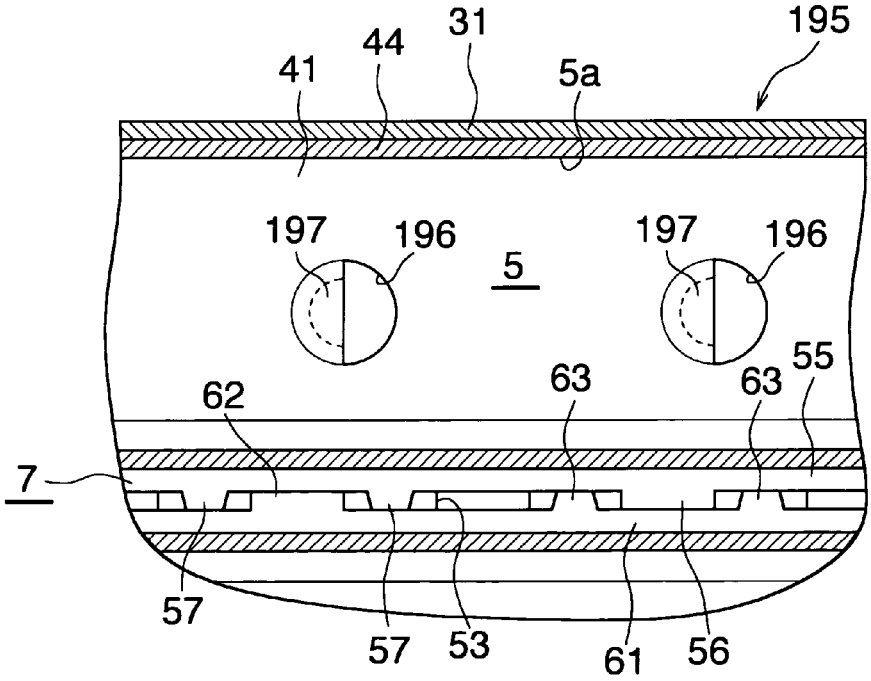
FIG. 26 is a cross sectional view taken along line L-L of FIG. 25.
Figure 27:
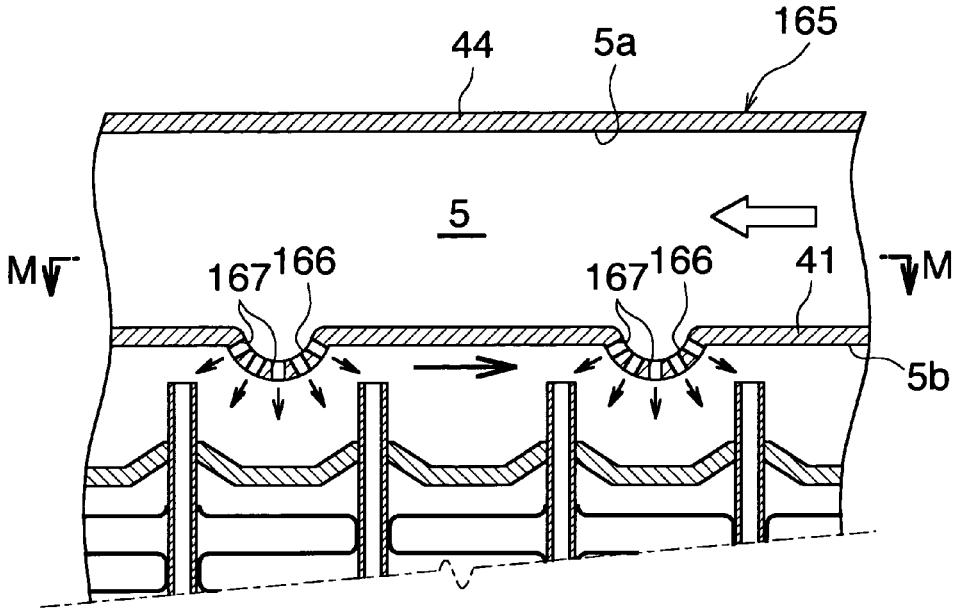
FIG. 27 is a view corresponding to the main portion of FIG. 6 and showing a portion of an evaporator using a sixth modification of the second member.
Figure 28:
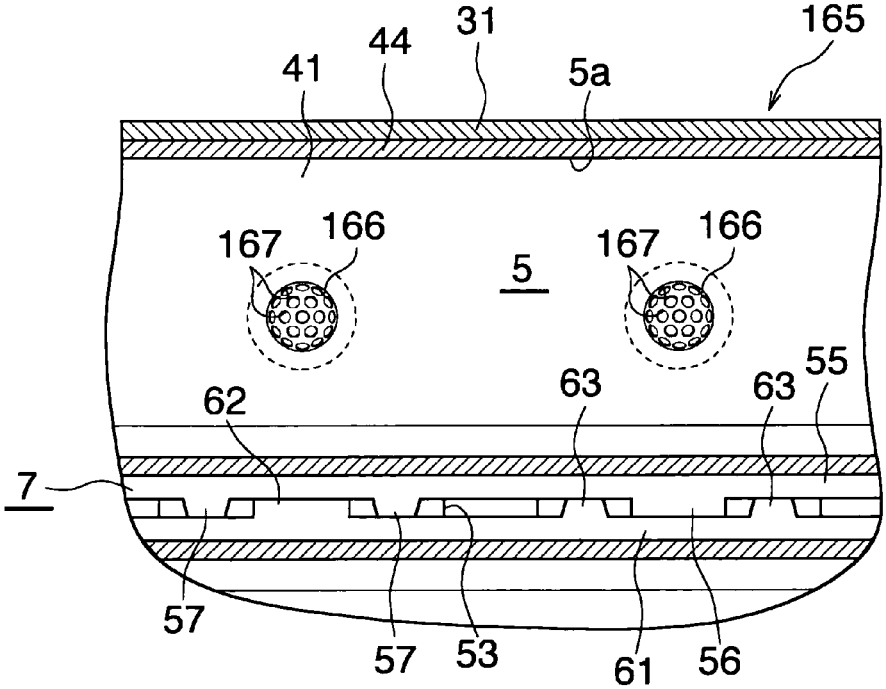
FIG. 28 is a cross sectional view taken along line M-M of FIG. 27.
Figure 29:
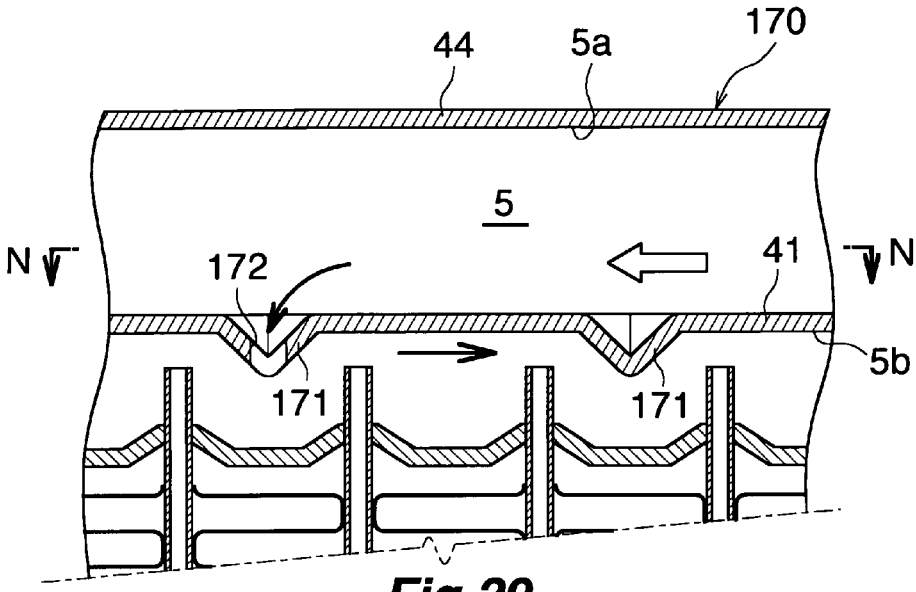
FIG. 29 is a view corresponding to the main portion of FIG. 6 and showing a portion of an evaporator using a seventh modification of the second member.
Figure 30:
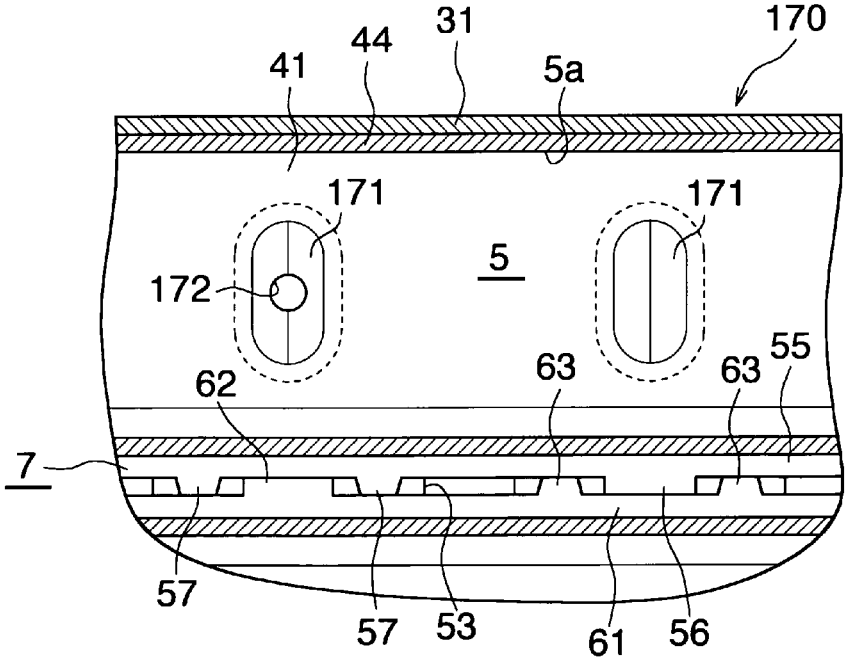
FIG. 30 is a cross sectional view taken along line N of FIG. 29.
Figure 31:
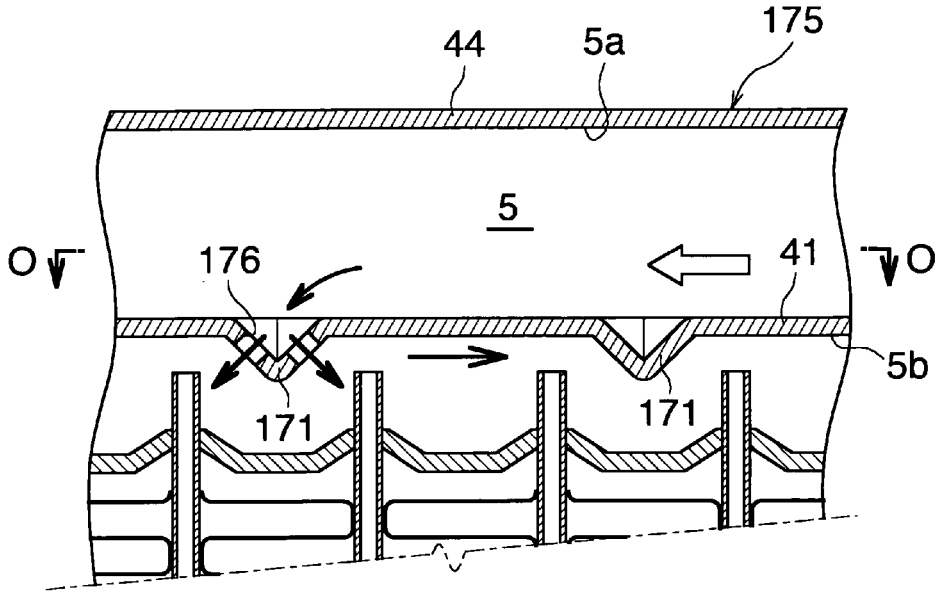
FIG. 31 is a view corresponding to the main portion of FIG. 6 and showing a portion of an evaporator using an eighth modification of the second member.
Figure 32:
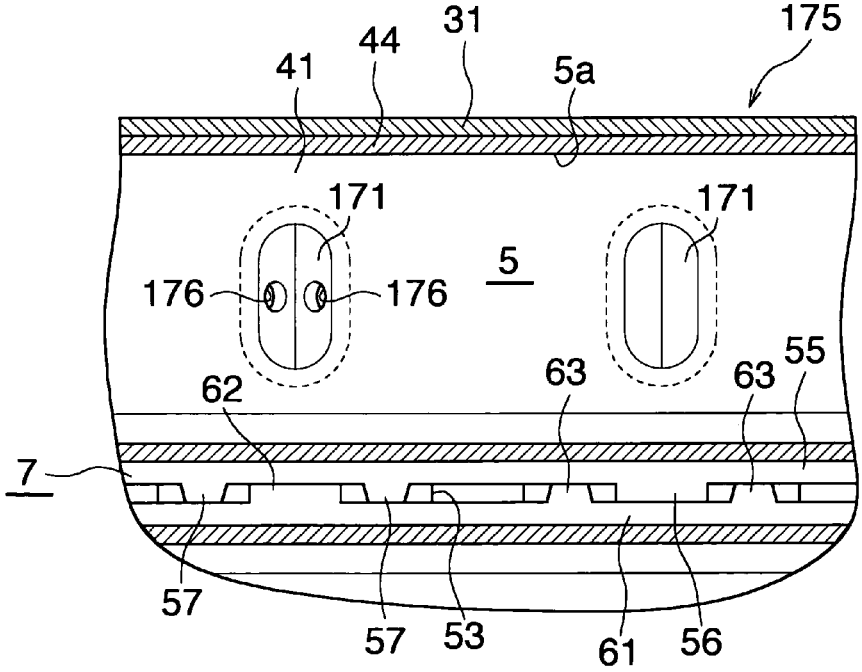
FIG. 32 is a cross sectional view taken along line O-O of FIG. 31.
Figure 33:
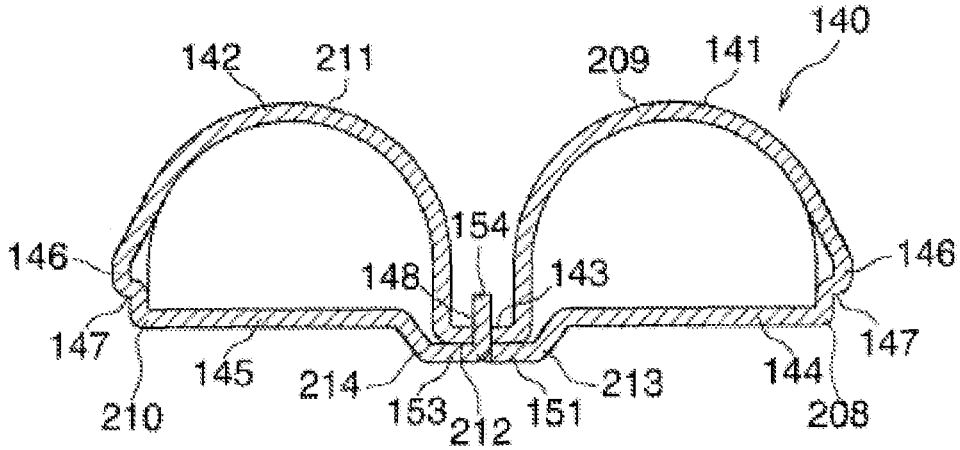
FIG. 33 is a transverse cross sectional view showing a ninth modification of the second member.
Figure 34:
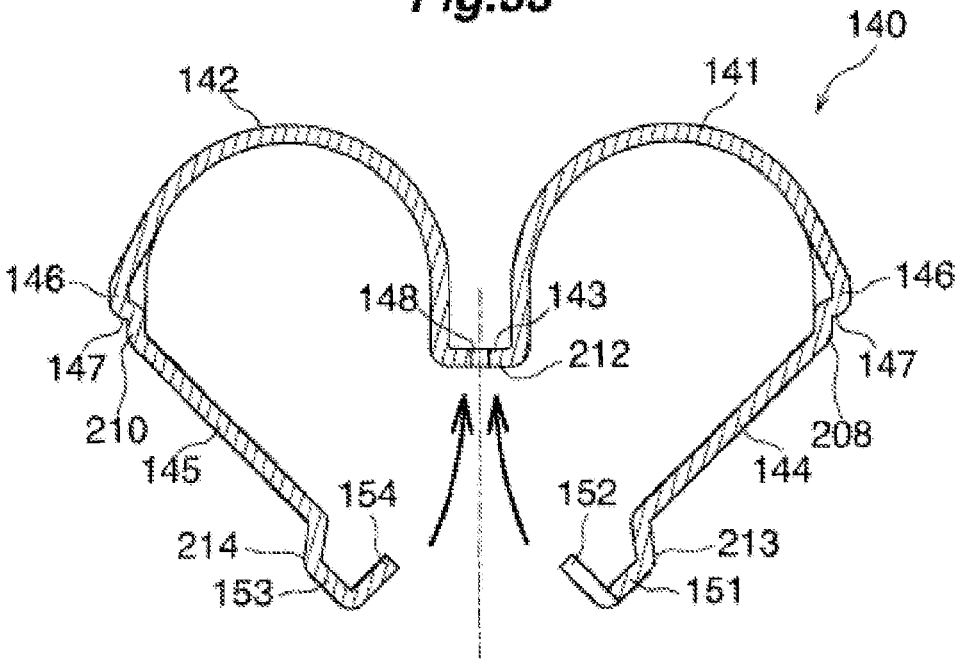
FIG. 34 is a transverse cross sectional view showing a step of a method of manufacturing the second member of FIG. 33.
Figure 35:
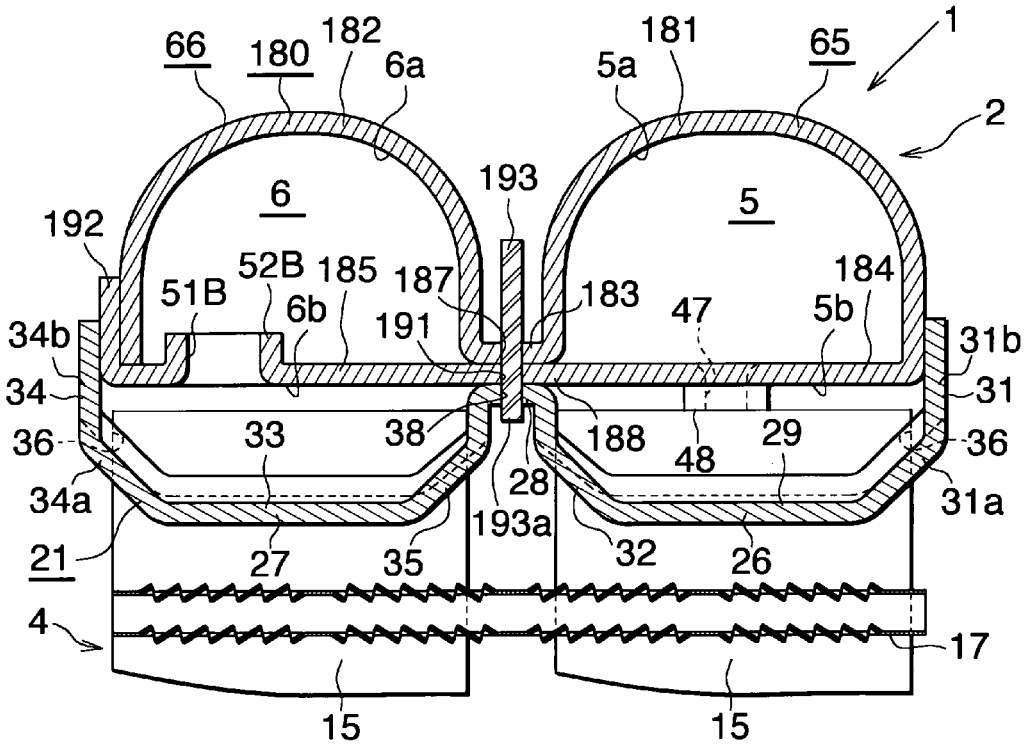
FIG. 35 is a view corresponding to the main portion of FIG. 3 and showing a portion of an evaporator using a tenth-modification of the second member.
Figure 36:
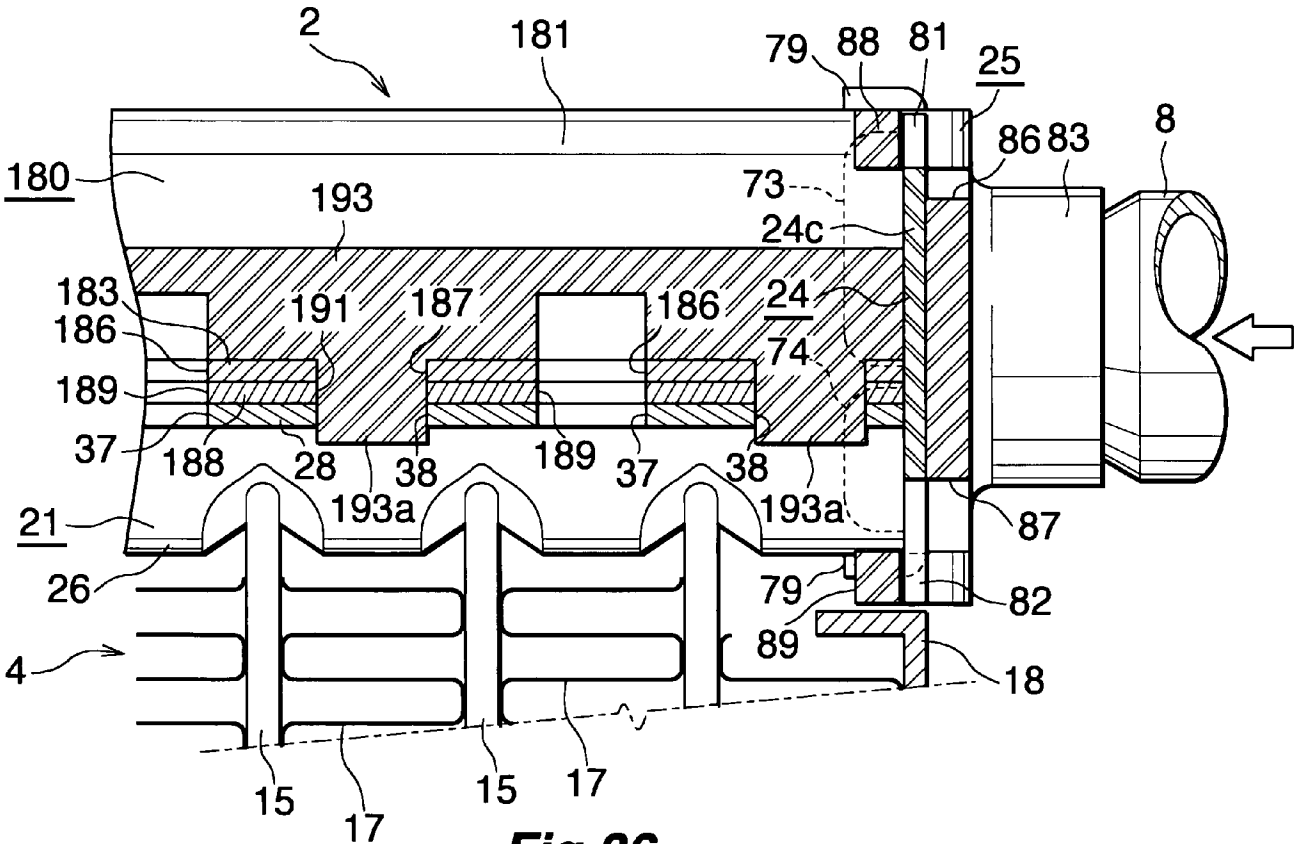
FIG. 36 is a view corresponding to FIG. 13 and showing a portion of an evaporator using the second member of FIG. 35.
Figure 37:
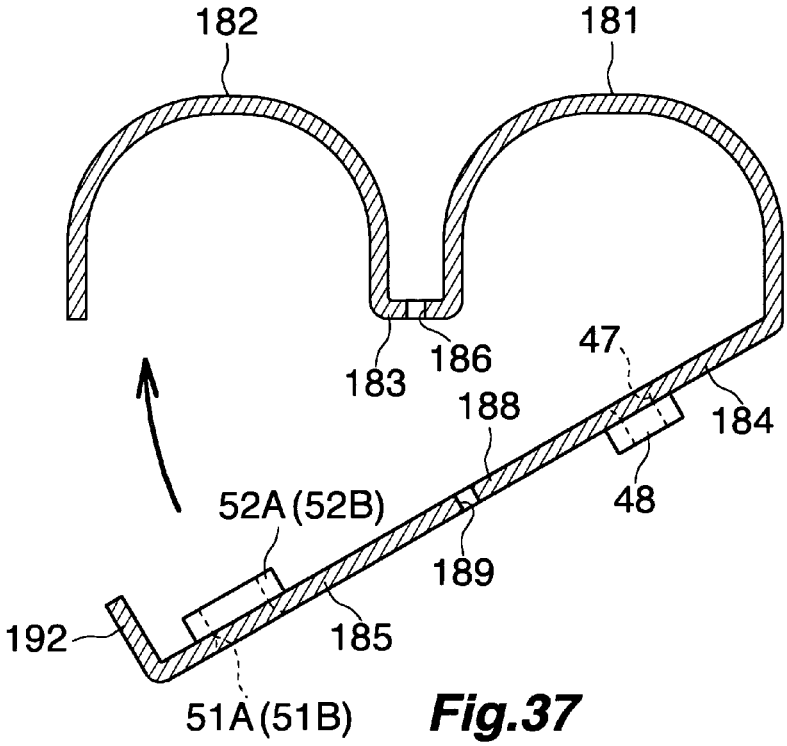
FIG. 37 is a transverse cross sectional view showing a step of a method of manufacturing the second member of FIG. 35.
Figure 38:
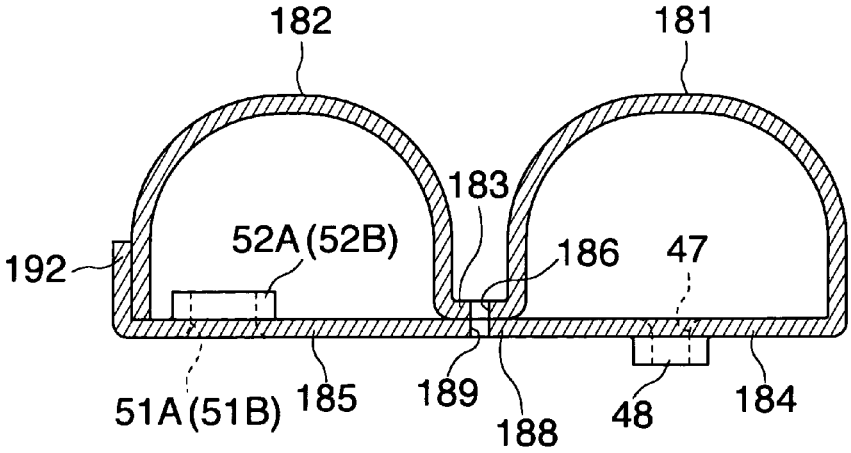
FIG. 38 is a transverse cross sectional view showing a step of the method of manufacturing the second member of FIG. 35, the step being different from the step of FIG. 37.

The invention claimed is:

1. A heat exchanger comprising a pair of header tanks disposed such that they are separated from each other; and a plurality of heat exchange tube groups arranged in a front to rear direction between the header tanks, each heat exchange tube group consisting of a plurality of heat exchange tubes which are arranged at predetermined intervals along a longitudinal direction of the header tank and opposite end portions of each heat exchange tube group are connected to the corresponding header tanks, and each of the header tanks including two header sections arranged in the front to rear direction and integrated together, wherein each of header tanks is composed of a first member to which the heat exchange tubes are connected and a second member which is joined to the first member and covers a side of the first member opposite the heat exchange tubes, and at least one heat exchange tube group is provided between each header section of one header tank and the corresponding header section of the other header tank, wherein the first member of the header tank includes a front and a rear header forming portions which form the heat exchange tube side of each header section and a connection wall which integrally connects both header forming portions, the second member of at least one head tank is formed by bending a metal plate comprising; partition portions which divide the respective header sections into two, upper and lower, spaces; a connection wall which connects both partition portions and overlaps an outer side in a vertical direction of the connection wall of the first member; a front header forming portion which is integrally connected to a front edge portion of a front partition portion, having a generally U-shaped transverse cross section opening down ward, and forming a vertically outer portion of a front header portion; and a rear header forming portion which is integrally connected to a rear edge portion of a rear partition portion, having a generally U-shaped transverse cross section opening down ward, and forming a vertically outer portion of a rear header portion, the connection wall of the first member and the connection wall of the second member have a plurality of through holes at the same position such that the through holes are separated from one another at predetermined intervals in the longitudinal direction of the connection walls, through holes, for establishing communication between the upper and lower spaces in each header section, are formed on each partition portion of the second member, and, a surface contact portion which projects rearwardly and surface contacts with a vertically outward surface of the connection wall of the second member is integrally formed on a rear edge portion of the front header forming portion of the second member; another surface contact portion which projects forwardly and surface contacts with the vertically outward surface of the connection wall of the second member is integrally formed on a front edge portion of the rear header forming portion of the second member; and a plurality of projections which respectively project vertically inward and are inserted through some through holes among all through holes on the connection walls of the first and second members are integrally formed such that the projections are separated from one another at predetermined intervals in the longitudinal direction.

2. A heat exchanger according to claim 1, wherein the second members of the two header tanks are each formed by bending a metal plate.

3. A heat exchanger according to claim 1, wherein a plurality of through holes are formed in the partition portion of the second member provided within a header section in which refrigerant flows into the heat exchange tubes.

4. A heat exchanger according to claim 3, wherein flanges are integrally formed on a surface of the partition portion having the plurality of through holes, the surface facing the heat exchange tubes, such that the flanges project toward the heat exchange tubes from circumferential edges of the corresponding through holes.

5. A heat exchanger according to claim 3, wherein guide portions for guiding refrigerant toward the heat exchange tubes from the space opposite the heat exchange tubes are integrally formed on one surface of the partition portion having the plurality of through holes such that the guide portions project from circumferential edges of the corresponding through holes.

6. A heat exchanger according to claim 5, wherein the guide portions are integrally formed on a surface of the partition portion having the plurality of through holes, the surface facing the heat exchange tubes, such that the guide portions project from portions of circumferential edges of the corresponding through holes, the portions being located on the upstream sides of the through holes with respect to a flow direction of refrigerant within a space, opposite the heat exchange tubes, of the header section in which refrigerant flows into the heat exchange tubes.

7. A heat exchanger according to claim 5, wherein the guide portions are integrally formed on a surface of the partition portion having the plurality of through holes, the surface facing opposite the heat exchange tubes, such that the guide portions project from portions of circumferential edges of the corresponding through holes, the portions being located on downstream sides of the through holes with respect to a flow direction of refrigerant within a space, opposite the heat exchange tubes, of the header section in which refrigerant flows into the heat exchange tubes.

8. A heat exchanger according to claim 3, wherein each of the through holes is formed between adjacent heat exchange tubes.

9. A heat exchanger according to claim 1, wherein a plurality of bulging portions are formed on the partition portion of the second member provided within a header section in which refrigerant flows into the heat exchange tubes such that the bulging portions project toward the heat exchange tubes and each have a flat projecting end wall; and at least one bulging portion includes a through hole formed in the projecting end wall.

10. A heat exchanger according to claim 9, wherein each of the bulging portions is formed between adjacent heat exchange tubes.

11. A heat exchanger according to claim 1, wherein hemispherical bulging portions are formed on the partition portion of the second member provided within a header section in which refrigerant flows into the heat exchange tubes such that the bulging portions project toward the heat exchange tubes; and at least one bulging portion includes a plurality of through holes formed therein.

12. A heat exchanger according to claim 1, wherein a plurality of projecting portions each having a V-shaped transverse cross section are formed on the partition portion of the second member provided within a header section in which refrigerant flows into the heat exchange tubes such that the projecting portions project toward the heat exchange tubes and extend in a width direction of the header tank; and a through hole is formed in a projecting portion such that the through hole extends over opposite wall portions of the projecting portion, which wall portions form the V shape.

13. A heat exchanger according to claim 1, wherein a plurality of projecting portions each having a V-shaped transverse cross section are formed on the partition portion of the second member provided within a header section in which refrigerant flows into the heat exchange tubes such that the projecting portions project toward the heat exchange tubes and extend in a width direction of the header tank; and a through hole is formed in each of opposite wall portions of a projecting portion, which wall portions form the V shape.

14. A heat exchanger according to claim 1, wherein the partition portions of the second member are horizontal plate-shaped.

15. A heat exchanger according to claim 14, wherein the connection walls of the first and second members are horizontal plate-shaped, and the through holes on the connection walls of the first and second members are divided into a group of through holes into which the projections of the front header forming portion are inserted, a group of through holes into which the projections of the rear header forming portion are inserted, and a group of through holes into which the projections of the two header forming portions are not inserted and which serve as drain through holes.

16. A heat exchanger according to claim 15, wherein abutment pieces which project rearwardly and abut against the surface contact portion of the rear header forming portion are formed on a distal end surface of the surface contact portion of the front header forming portion of the second member, and abutment pieces which project toward the forwardly and abut against the surface contact portion of the front header forming portion are formed on a distal end surface of the surface contact portion of the rear header forming portion of the second member, wherein the abutment pieces are formed such that they do not interfere with the projections of the two header forming portions and the drain through holes of the connection wall.

17. A heat exchanger comprising a pair of header tanks disposed such that they are separated from each other; and a plurality of heat exchange tube groups arranged in a front to rear direction between the header tanks, each heat exchange tube group consisting of a plurality of heat exchange tubes which are arranged at predetermined intervals along a longitudinal direction of the header tank and opposite end portions of each heat exchange tube group are connected to the corresponding header tanks, and each of the header tanks including two header sections arranged in the front-rear direction and integrated together, wherein each of the header tanks is composed of a first member to which the heat exchange tubes are connected and a second member which is joined to the first member and covers a side of the first member opposite the heat exchange tubes, and at least one heat exchange tube group is provided between each header section of one header tank and the corresponding header section of the other header tank, wherein the first member of the header tank includes a front and a rear header forming portions which form the heat exchange tube side of each header section and a connection wall which integrally connects both header forming portions, the second member of at least one head tank is formed by bending a metal plate comprising; partition portions which divide the respective header sections into two, upper and lower, spaces; a front header forming portion which is integrally connected to a front edge portion of a front partition portion, having a generally U-shaped tranversed cross section opening down ward, and forming a vertically outer portion of a front header portion; and a rear header forming portion which is integrally connected to a rear edge portion of a rear partition portion, having a generally U-shaped transverse cross section opening down ward, and forming a vertically outer portion of a rear header portion; and a connection wall connecting both header forming portions, through holes, for establishing communication between the upper and lower spaces in each header section, are formed on each partition portion of the second member, and, the connection wall of the second member has a plurality of through holes formed such that the holes are separated from one another at predetermined intervals in the longitudinal direction; a surface contact portion which projects rearwardly and surface contacts with a vertically inward surface of the connection wall of the second member is integrally formed on a rear edge portion of the front partition portion of the second member; another surface contact portion which projects forwardly and surface contacts with the vertically inward surface of the connection wall of the second member is integrally formed on a front edge portion of the rear partition portion of the second member; and a plurality of projections which respectively project vertically outward and are inserted through some through holes among all through holes on the communication wall of the second member are integrally formed such that the projections are separated from one another at predetermined intervals in the longitudinal direction.

18. A heat exchanger according to claim 17, wherein each partition portion of the second member are horizontal plate-shaped, the communication walls of the first and second members are horizontal plate-shaped, and the through holes on the communication wall of the second member are divided into a group of through holes into which the projections of the front partition portion are inserted, a group of through holes into which the projections of the rear partition portion are inserted, and a group of through holes into which the projections of the two partition portions are not inserted and which serve as drain through holes.

19. A heat exchanger according to claim 18, wherein abutment pieces which project rearwardly and abut against the surface contact portion of the rear partition portion are formed on a distal end surface of the surface contact portion of the front partition portion of the second member, and abutment pieces which project toward the forwardly and abut against the surface contact portion of the front partition portion are formed on a distal end surface of the surface contact portion of the rear partition portion of the second member, wherein the abutment pieces are formed such that they do not interfere with the projections of the two partition portions and the drain through holes of the connection wall.

20. A heat exchanger according to claim 1, wherein engagement portions with which front and rear edge portions of the first member are engaged are formed at front and rear edge portions of the second member.

21. A heat exchanger according to claim 1, wherein a front header section of one header tank serves as a refrigerant inlet header section, the rear header section of the one header tank serves as a refrigerant outlet header section, the front header section of the other header tank serves as a first intermediate header section, and the rear header section of the other header tank serves as a second intermediate header section; a refrigerant inlet is formed in one end portion of the refrigerant inlet header section, and a refrigerant outlet is formed in one end portion of the refrigerant outlet header section located on the same side as the end portion of the refrigerant inlet header section; and each of the refrigerant inlet header section and the second intermediate header section serves as a header section in which refrigerant flows into the heat exchange tubes.

22. A heat exchanger according to claim 21, wherein a communication hole is formed in an end portion of the partition portion opposite the refrigerant inlet and the refrigerant outlet so as to establish communication between the two spaces of the refrigerant inlet header section; and a communication member is provided at one longitudinal end of the header tank so as to establish communication between an interior space of the first intermediate header section with respect to the vertical direction and an interior space of the second intermediate header section with respect to the vertical direction.

23. A heat exchanger according to claim 17, wherein a front header section of one header tank serves as a refrigerant inlet header section, the rear header section of the one header tank serves as a refrigerant outlet header section, the front header section of the other header tank serves as a first intermediate header section, and the rear header section of the other header tank serves as a second intermediate header section; a refrigerant inlet is formed in one end portion of the refrigerant inlet header section, and a refrigerant outlet is formed in one end portion of the refrigerant outlet header section located on the same side as the end portion of the refrigerant inlet header section; and each of the refrigerant inlet header section and the second intermediate header section serves as a header section in which refrigerant flows into the heat exchange tubes.

24. A heat exchanger according to claim 23, wherein a communication hole is formed in an end portion of the partition portion opposite the refrigerant inlet and the refrigerant outlet so as to establish communication between the two spaces of the refrigerant inlet header section; and a communication member is provided at one longitudinal end of the header tank so as to establish communication between an interior space of the first intermediate header section with respect to the vertical direction and an interior space of the second intermediate header section with respect to the vertical direction.

* * * * *